US006210284B1

(12) United States Patent
Ochi

(10) Patent No.: US 6,210,284 B1
(45) Date of Patent: Apr. 3, 2001

(54) RIDES CONVEYING PARK-GOERS IN THEIR OWN MOTOR VEHICLES

(75) Inventor: Yasushi Ochi, Osaka (JP)

(73) Assignee: Oriental Sangyo Co., Ltd., Osaka (JP)

( * ) Notice: Subject to any disclaimer, the term of this patent is extended or adjusted under 35 U.S.C. 154(b) by 0 days.

(21) Appl. No.: 09/385,852

(22) Filed: Aug. 30, 1999

Related U.S. Application Data

(63) Continuation-in-part of application No. 09/149,030, filed on Sep. 8, 1998.

(51) Int. Cl.[7] ..... A63G 15/06

(52) U.S. Cl. ..... 472/32; 472/13

(58) Field of Search ..... 472/32, 33, 34, 472/35, 13; 104/87, 89, 90, 27; 105/149.1; 410/4, 6

(56) References Cited

U.S. PATENT DOCUMENTS

| | | | | |
|---|---|---|---|---|
| 3,247,539 | * | 4/1966 | Pleasant | 104/87 |
| 3,355,580 | * | 11/1967 | Wachs | 472/32 X |
| 4,909,155 | * | 3/1990 | Katayama | 105/148 |
| 4,936,222 | * | 6/1990 | Murai | 104/89 |
| 5,058,508 | * | 10/1991 | Kavieff et al. | 105/149 |

FOREIGN PATENT DOCUMENTS

| | | |
|---|---|---|
| 7-17394 | 1/1995 | (JP) . |
| 8-239033 | 9/1996 | (JP) . |
| 8-282476 | 10/1996 | (JP) . |

* cited by examiner

*Primary Examiner*—Kien T. Nguyen
(74) *Attorney, Agent, or Firm*—Shinjyu Intellectual Property Firm

(57) ABSTRACT

A cable driven ride includes at least one carriage configured to receive and support an motorized passenger vehicle filled with at least one passenger and move with a cable as the cable is moved between at least one terminal and a tower, the cable extending therebetween.

4 Claims, 31 Drawing Sheets

RIDES CONVEYING PARK-GOERS IN THEIR OWN MOTOR VEHICLES

This application is a continuation in part of U.S. patent application Ser. No. 09/149,030 filed Sep. 8, 1998.

BACKGROUND OF THE INVENTION

A. Field of the Invention

The present invention relates to amusement park rides which use passenger vehicles as a means for carrying persons on amusement rides.

B. Description of the Related Art

Traditionally, amusement parks have a variety of rides. In particular, rides such as Ferris wheels and roller coasters typically have carriages or carts permanently mounted on supports in the ride, including seats to accommodate thrill seekers. For instance, on a Ferris wheel, a series of pivoting carriages with seats are mounted about the outer periphery of the Ferris wheel. Thrill seekers are seated in the seats and the Ferris wheel rotates lifting the thrill seekers up to view local scenery and the like. Roller coasters typically have a car mounted on tracks. The car includes several seats and restraining devices, such as seat belts, or harnesses, which restrain the thrill seeker as the car rides on the tracks.

Amusement parks are very popular. One of many problems most people experience while visiting an amusement park is the enormous amount of walking between rides and attractions. Another big problem with amusement parks is that the more popular rides have long lines of people waiting to enjoy the ride. People must stand and wait for extended periods of time, with little in the way of comforts or leisurely pleasures. Standing and waiting detracts from the enjoyment of the amusement park.

SUMMARY OF THE INVENTION

One object of the present invention is to make amusement parks more attractive by providing thrill seekers with a more comfortable way to travel between rides and wait in line for those rides.

In accordance with one aspect of the present invention, a cable driven ride includes at least one supporting tower, at least one terminal spaced apart from the supporting tower and a cable extending between the tower and the terminal. The cable is supported by the tower such that the cable is continuously moveable between the tower and the terminal. A means for moving the cable between the tower and the terminal is provided in the terminal. At least one carriage is engagable with the cable such that the carriage is moveable with the cable between the tower and the terminal The carriage is configured to support and carry a motorized passenger vehicle.

Preferably, the carriage includes a front gate which secures the motorized passenger vehicle thus preventing movement of the motorized passenger vehicle with respect to the carriage.

Preferably, the carriage includes a platform and front and rear gates supported on the platform, the front and rear gates being configured to secure the motorized passenger vehicle to the platform thus preventing movement of the motorized passenger vehicle with respect to the carriage, and the platform being further provided with a plurality of rollers which may be selectively braked against rolling movement.

Preferably, the carriage includes a generally flat platform upon which an automobile is positionable and at least two generally upright sides extending from the platform. At least one inflatable bag is fixed to at least one of the upright sides and upon inflation the inflatable bag engages and secures the motorized passenger vehicle on the platform.

Preferably, a gate mounted to the platform, the gate including a second inflatable bag.

These and other objects, features, aspects and advantages of the present invention will become more fully apparent from the following detailed description of the present invention when taken in conjunction with the accompanying drawings where like reference numerals denote corresponding parts throughout.

DETAILED DESCRIPTION OF THE PREFERRED EMBODIMENTS

Figure 1:
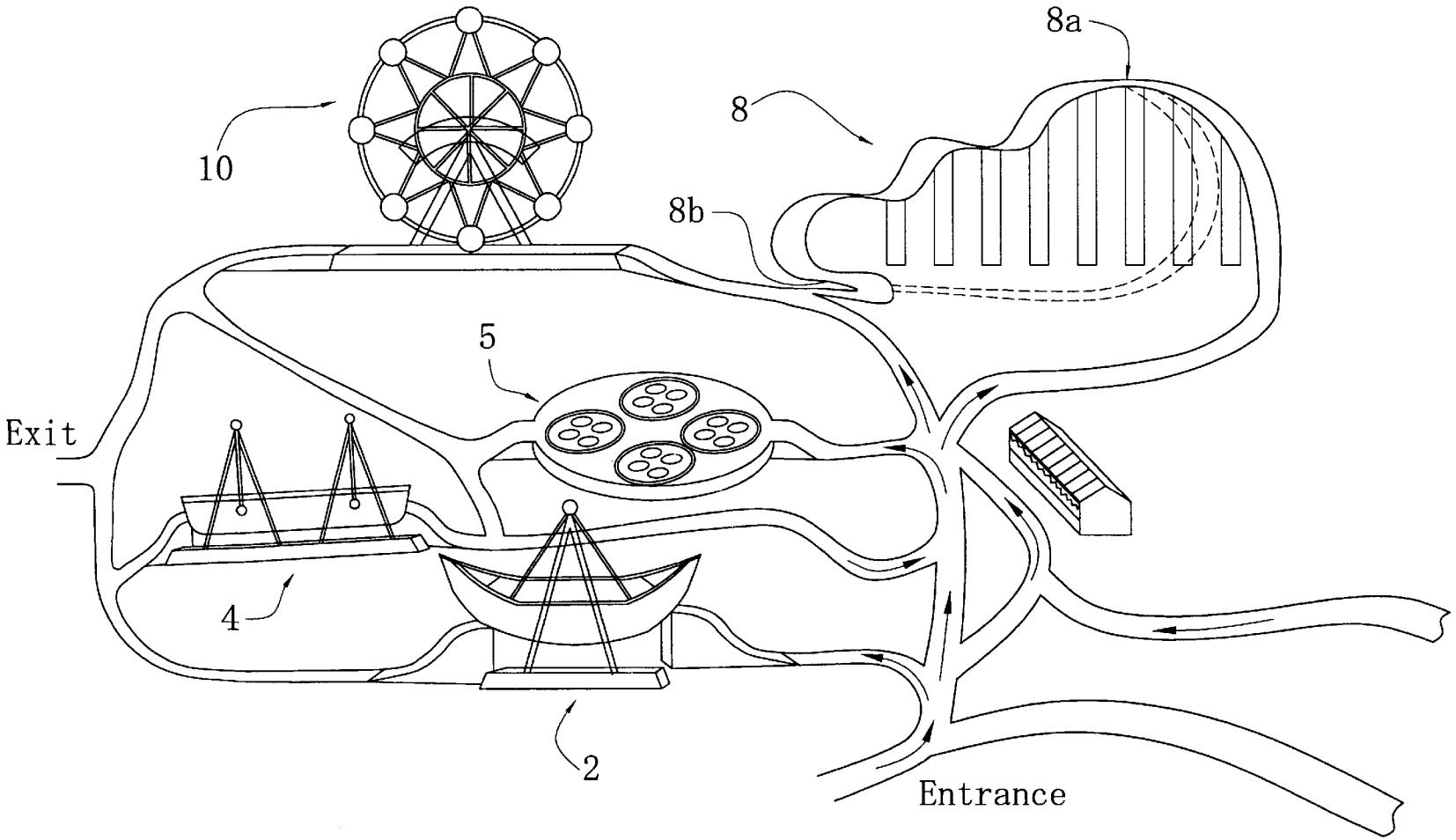
FIG. 1 is a schematic representation of a first section of an amusement park having a variety of rides in accordance with one embodiment of the present invention.
Figure 2:
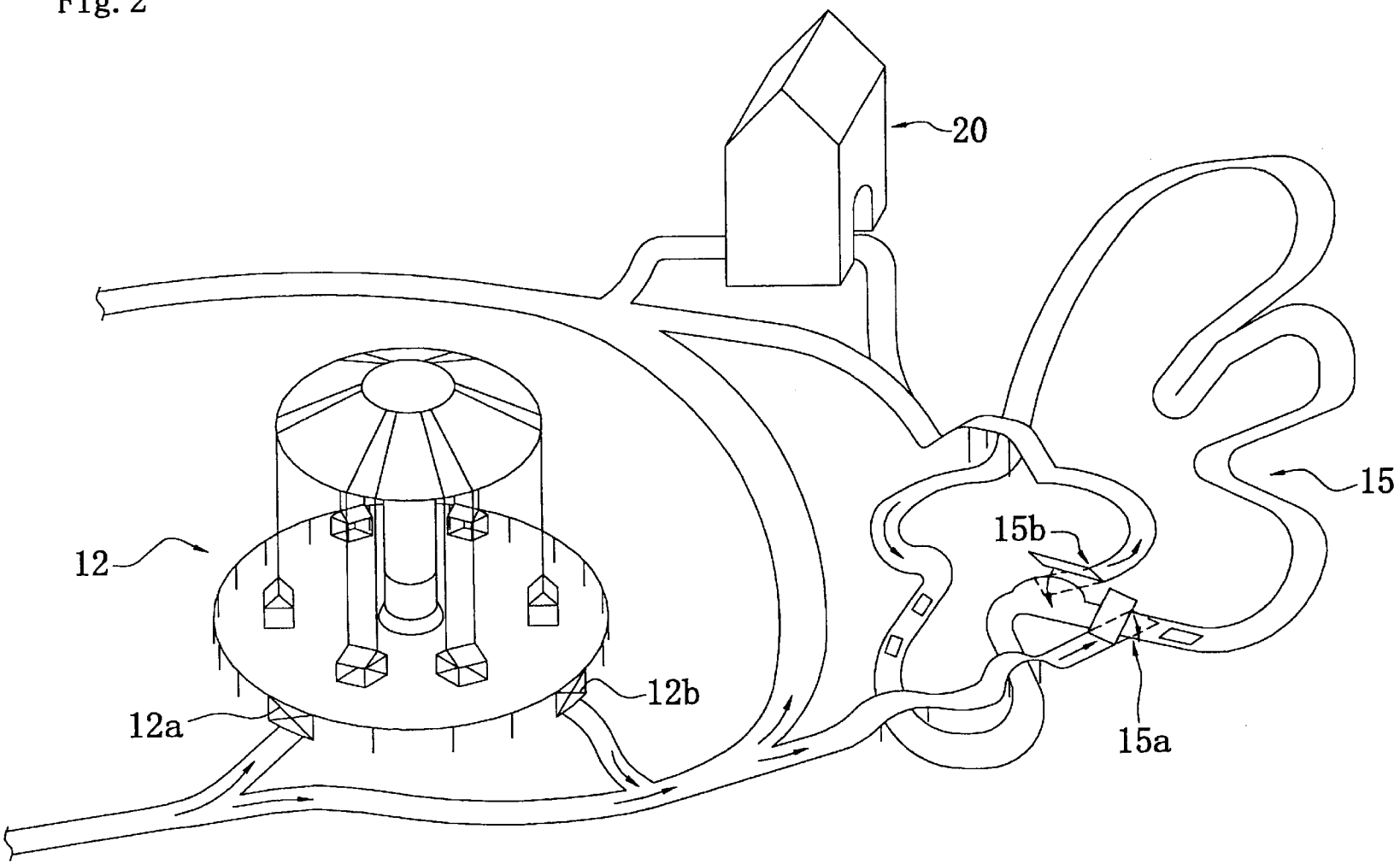
FIG. 2 is a schematic representation of a second section of the amusement park having further rides in accordance with one embodiment of the present invention.

FIG. 1 is a schematic representation of a first section of an amusement park having a variety of rides in accordance with one embodiment of the present invention. The rides include a pirate boat ride 2, a looping boat ride 4, a saucer tea cup ride 5, a roller coaster ride 8 and a Ferris wheel ride. In FIG. 2, a second section of the amusement park is shown having swing ride 12, a water flume ride 15 and an adventure theater 20.

Each of the rides includes an entrance and an exit and corresponding loading and unloading areas. For instance, the roller coaster ride 8 includes a loading zone 8*a* and an unloading zone 8*b*. Likewise, the swing ride 12 has a loading zone 12*a* and an unloading zone 12*b*, and the water flume ride 15 has a loading zone 15*a* and an unloading zone 15*b*.

Figure 3:
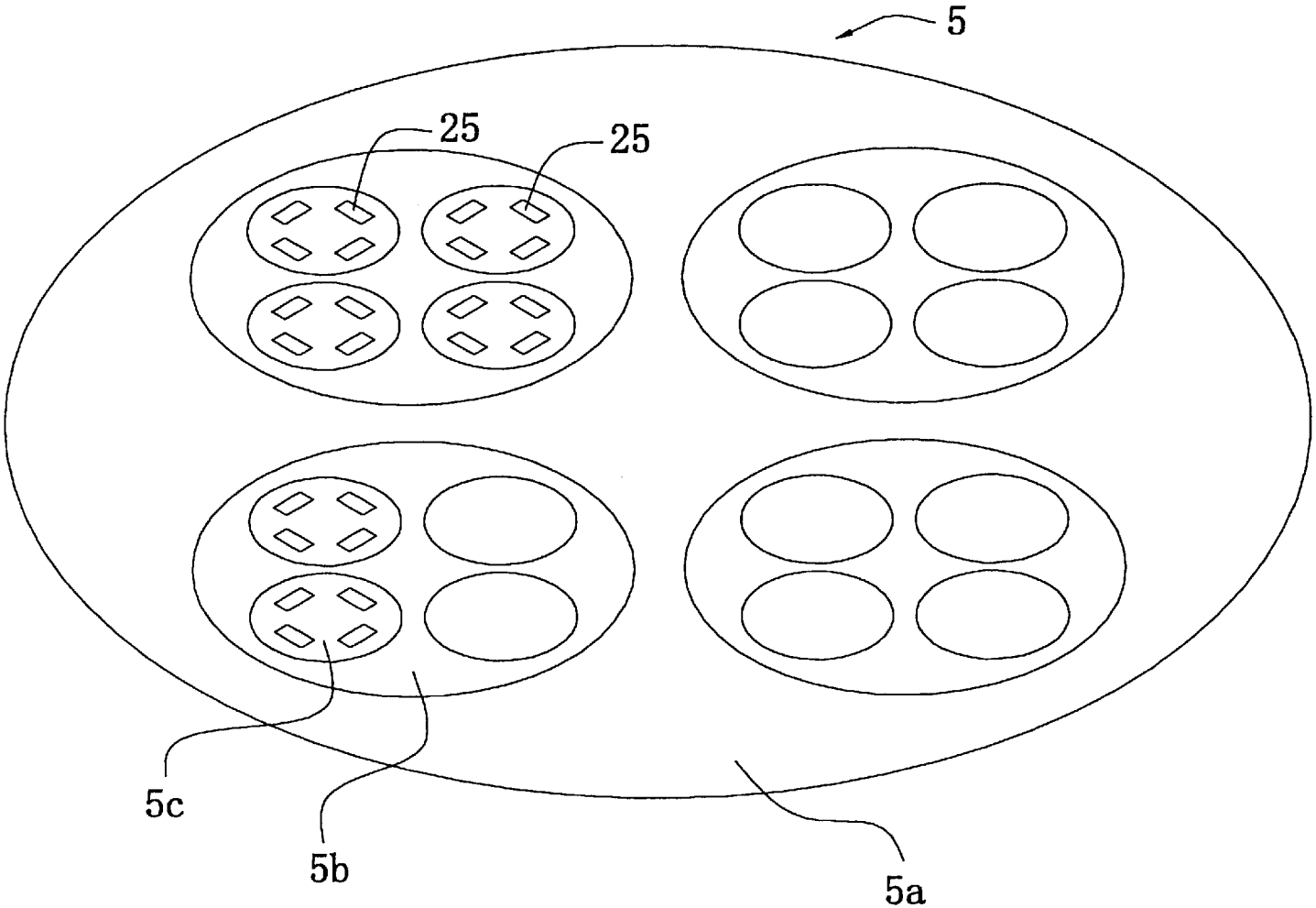
FIG. 3 is a schematic representation of a saucer tea cup ride having car supporting mechanisms.
Figure 5:
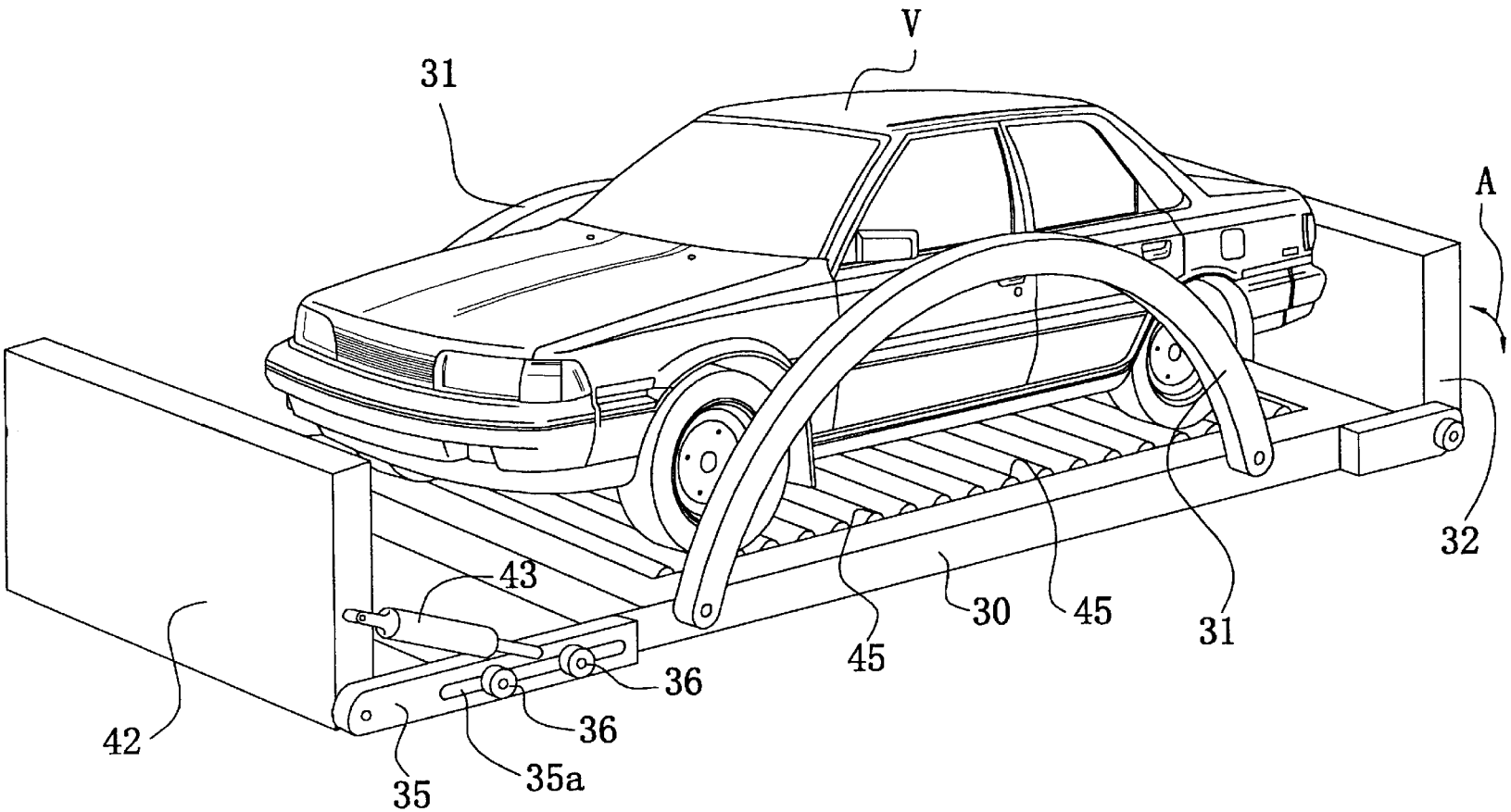
FIG. 5 a car support mechanism used in the rides in the amusement park.

Each of the above mentioned rides is configured to receive and secure automotive vehicles such as the vehicle V shown in FIG. 5. Each ride is therefore provided with a plurality of car supporting mechanisms 25, such as the car supporting mechanisms 25 shown in FIG. 3 on the saucer tea cup ride 5. The saucer tea cup ride 5 includes a large saucer 5*a* which is connected to a large motor (not shown) such that the large saucer 5*a* may be rotated about a central axis thereof. Within the structure of the large saucer 5*a* are four intermediate saucers 5*b* which are each provided with power to rotate about a central axis thereof while the large saucer 5*a* is rotated. Further, each intermediate saucer 5*b* has four small saucers 5*c* which rotate about a central axis thereof while the saucers 5*a* and 5*b* are rotated. Each small saucer 5*c* includes four car supporting mechanisms 25, which are described in greater detail below.

Figure 4:
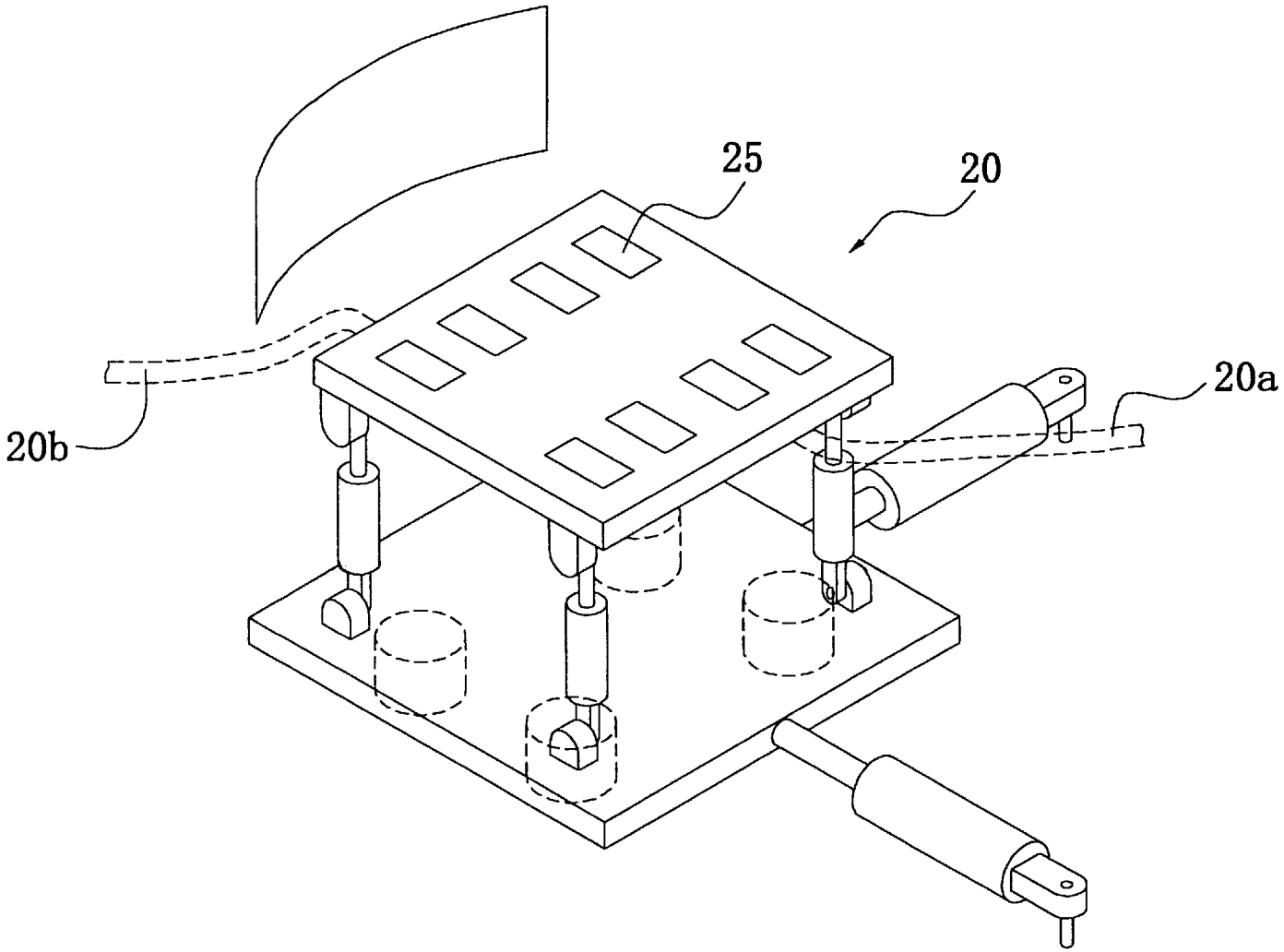
FIG. 4 is an adventure theater having car supporting mechanisms.

In FIG. 4, an adventure theater 20 is depicted. The adventure theater 20 includes a platform supported by a plurality of pressure controlled cylinders such that the platform may be moved in accordance with images projected on a screen. The theater 20 includes an on ramp 20*a* and an off ramp 20*b*. The theater 20 is also provided with a plurality of car supporting mechanisms 25.

FIGS. 5 through 11 depict various types of car support mechanisms 25 used in the rides in the amusement park. Each ride in the amusement park has its own dynamics, each with different requirements for securing automotive vehicles safely during the ride.

Figure 6:
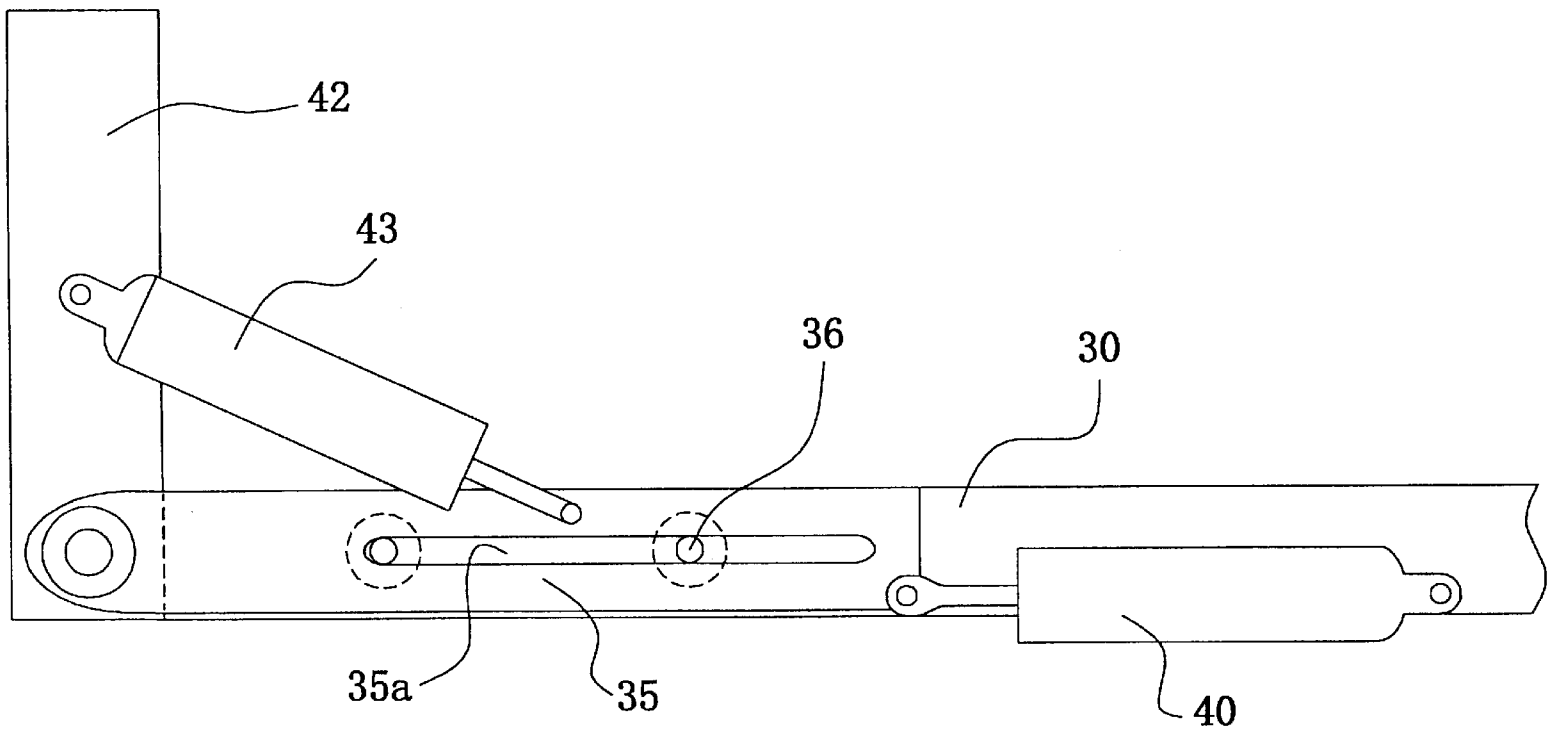
FIG. 6 is a fragmentary side view of the car support mechanism depicted in FIG. 5.

In FIGS. 5 and 6, the car support mechanism includes a platform 30 that includes a support bar 31 which may be made of a strong metal material coated with soft foam material to protect against contact with the car V. A swinging rear gate 32 is moveable up and down as indicated by the Arrow A and powered by a pressure cylinder (not shown).

In the front portion of the platform 30 there are two parallel sliding bars 35 (although only one bar 35 is visible). The sliding bar 35 is secured to the platform 30 but may slide along the pins 36. The sliding movement of the bar 35 is limited by the length of an elongated groove 35*a*. Movement of the bar 35 is controlled by a pressure cylinder 40 that is secured at one end to the platform 30 and secured to the bar 35 at the other end. A front gate 42 is pivotally mounted to the bar 35. Movement of the front gate 42 is controlled by a cylinder 43.

The platform 30 is further provided with a plurality of rollers 45. The rollers 45 are all generally parallel within the platform 30 and are freely rotatable. A braking mechanism (not shown) is mounted within the platform 30 for selectively restricting the rolling movement of the rollers 45.

The car supporting mechanism depicted in FIGS. 5 and 6 operates as follows. When a car is to be loaded on the car supporting mechanism, the rear gate 32 is lowered and the bar 35 is moved to a forward most position. The brake mechanism (not shown) is engaged such that the rollers 45 may not rotate within the platform 30. A car V is then driven onto the platform 30 and the rollers 45. Once the car V is in position, the rear gate 32 is raised and the front gate 42 is moved toward the front of the car V by positioning the sliding bar 35. It should be noted that the front and rear gates 42 and 32 are lined with a soft material such as foam in order to protect the car V from damage in the event of contact therebetween.

Next, the brake mechanism (not shown) is disengaged such that the rollers 45 may rotate freely within the platform 30. In this situation, the car V is secured within the car support mechanism 25 but may not move due to the front and rear gates 42 and 32. Further, in the event that the motor of the car V is running and the driver accidently presses on the accelerator, there is no risk of damage to the car V since the rollers 45 may rotate freely. Since the tires of the car V are engaged with the rollers 45, there is no danger of the car V leaving the car supporting mechanism 25 depicted in FIGS. 5 and 6.

The car support mechanism 25 depicted in FIGS. 5 and 6 is suitable for most of the rides in the amusement park but is particularly suitable for the boat rides 2 and 4 and for the roller coaster ride 8. A car can be driven easily onto the car supporting mechanism 25 and the car supporting mechanism moves in the amusement ride with the passengers of the car V in relative safety.

Figure 7:
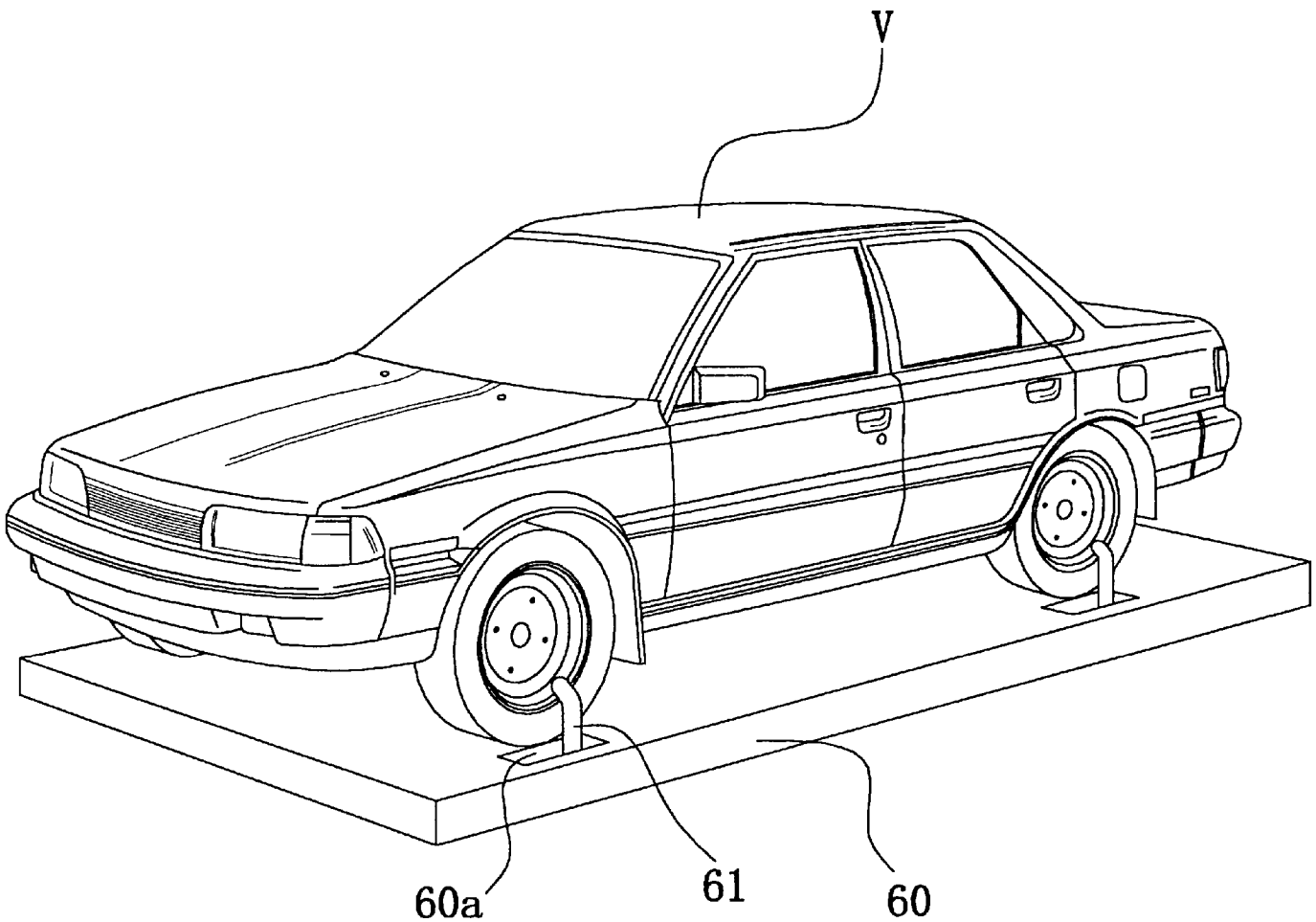
FIG. 7 is another car support mechanism.
Figure 8:
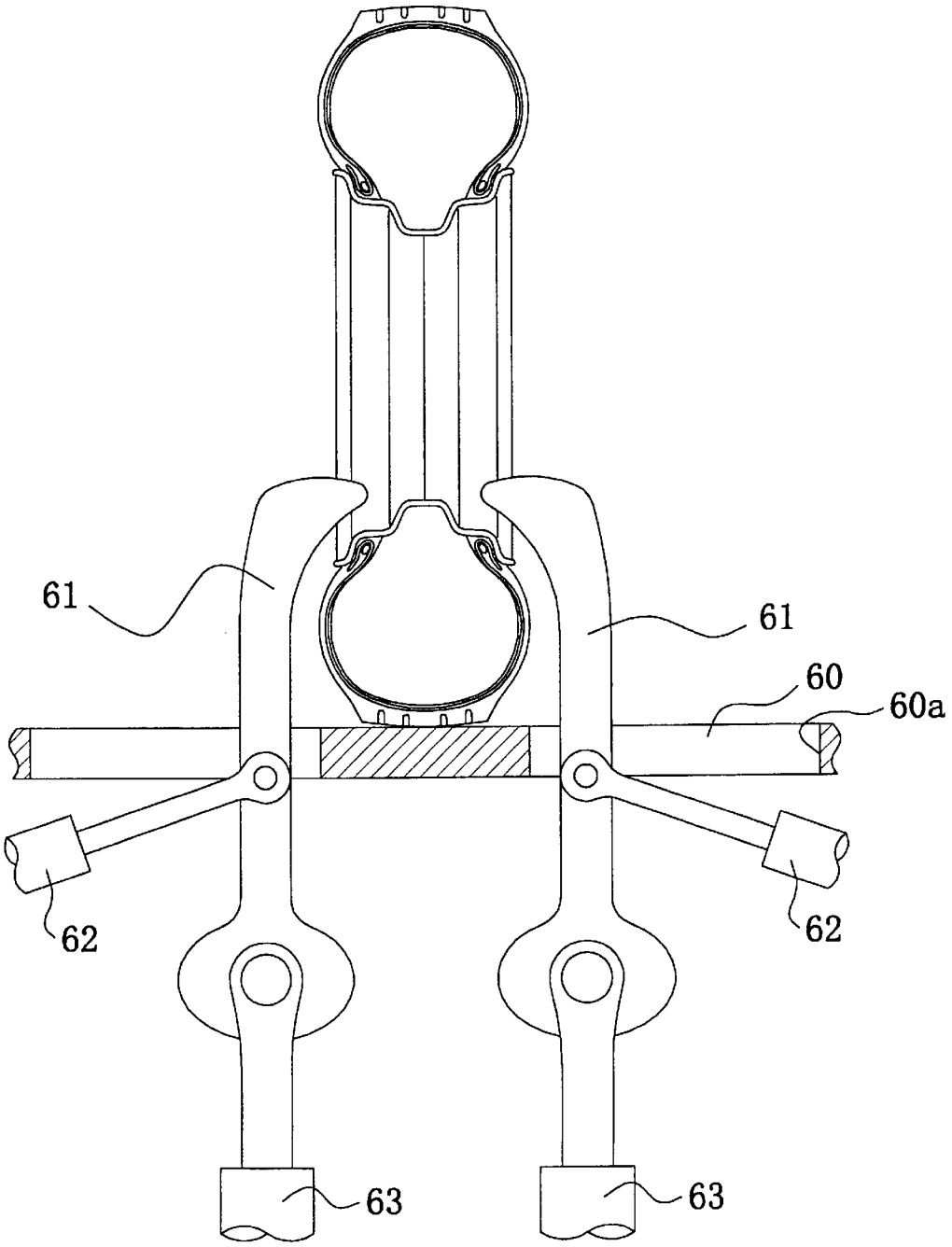
FIG. 8 is a fragmentary side view of the car support mechanism depicted in FIG. 7.

Another car support mechanism is depicted in FIGS. 7 and 8. In this mechanism, a car V is driven onto a platform 60 until the car V is approximately positioned adjacent to openings 60*a*. Once positioned, arms 61 are moved upward on either side of each tire of the car V. Next, the arms 61 can be moved toward one another until engaged with the tire. The movement of the arms 61 is controlled by the cylinders 62 and 63. Once engaged with the tires, the arms 61 securely hold the car V in position on the platform 60. Such a configuration of the car support mechanism may be used on, for instance, the saucer tea cup ride 5.

Figure 9:
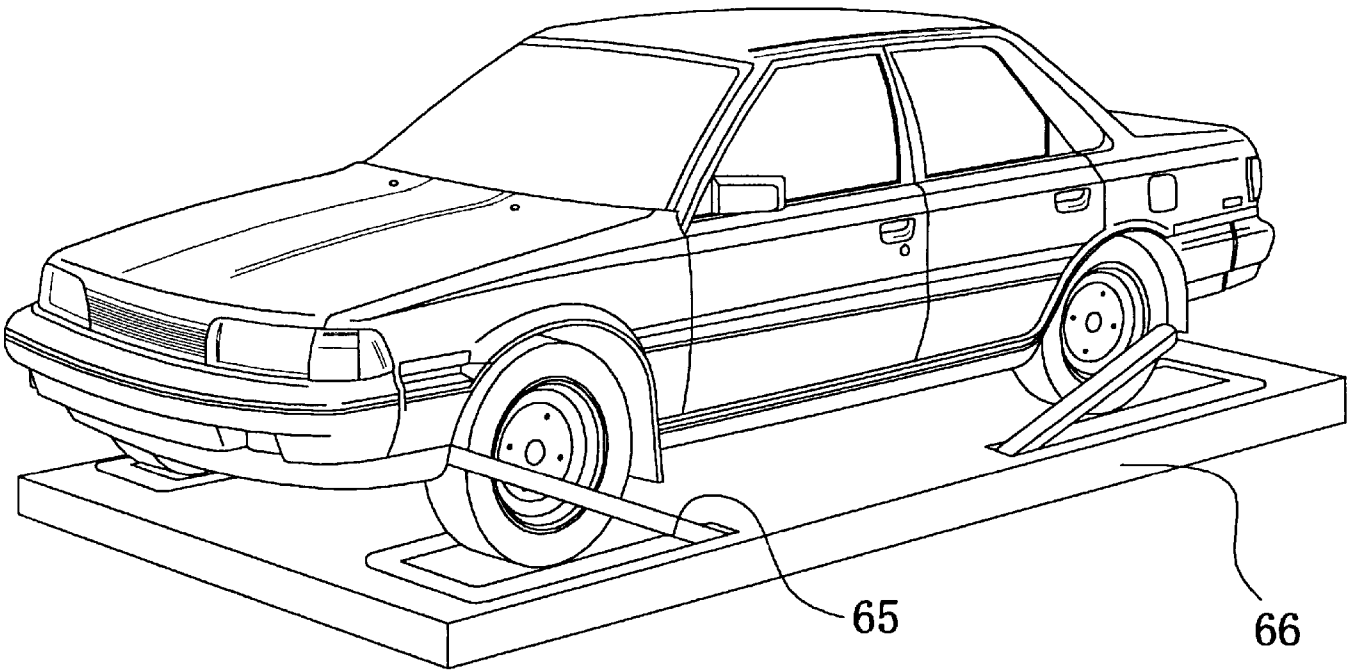
FIG. 9 is another car support mechanism.

A further car support mechanism is depicted in FIG. 9 where an arm 65 is extendable upward out of a platform 66.

Figure 10:
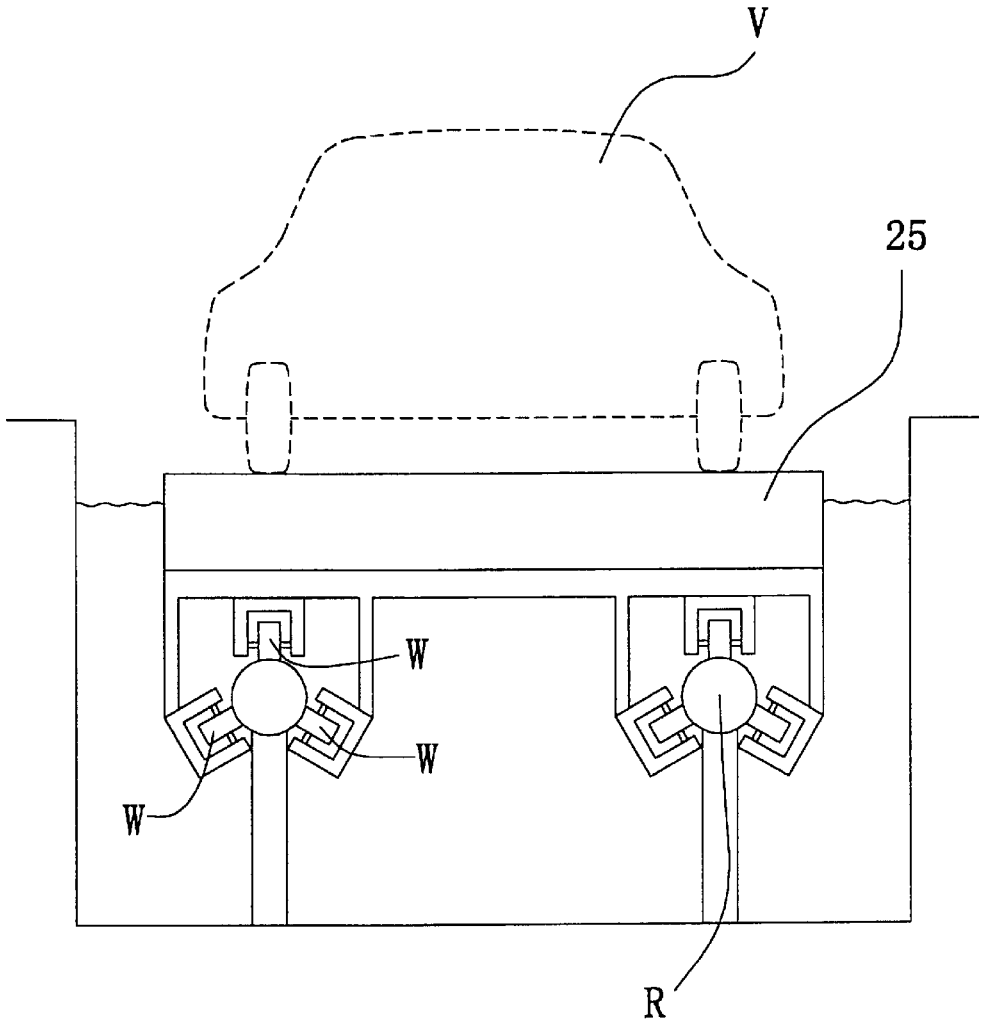
FIG. 10 is another car support mechanism.

The car support mechanisms 25 are supported in the rides in various ways. For instance, in both the roller coaster ride 8 and the water flume ride 15, the car support mechanism 25 is supported on rails R by support structures fixed to a lower portion of the car support mechanism 25, where the support structures include a plurality of wheels which engage the rails R. As shown in FIG. 10, the rails may be submerged under water.

Figure 11:
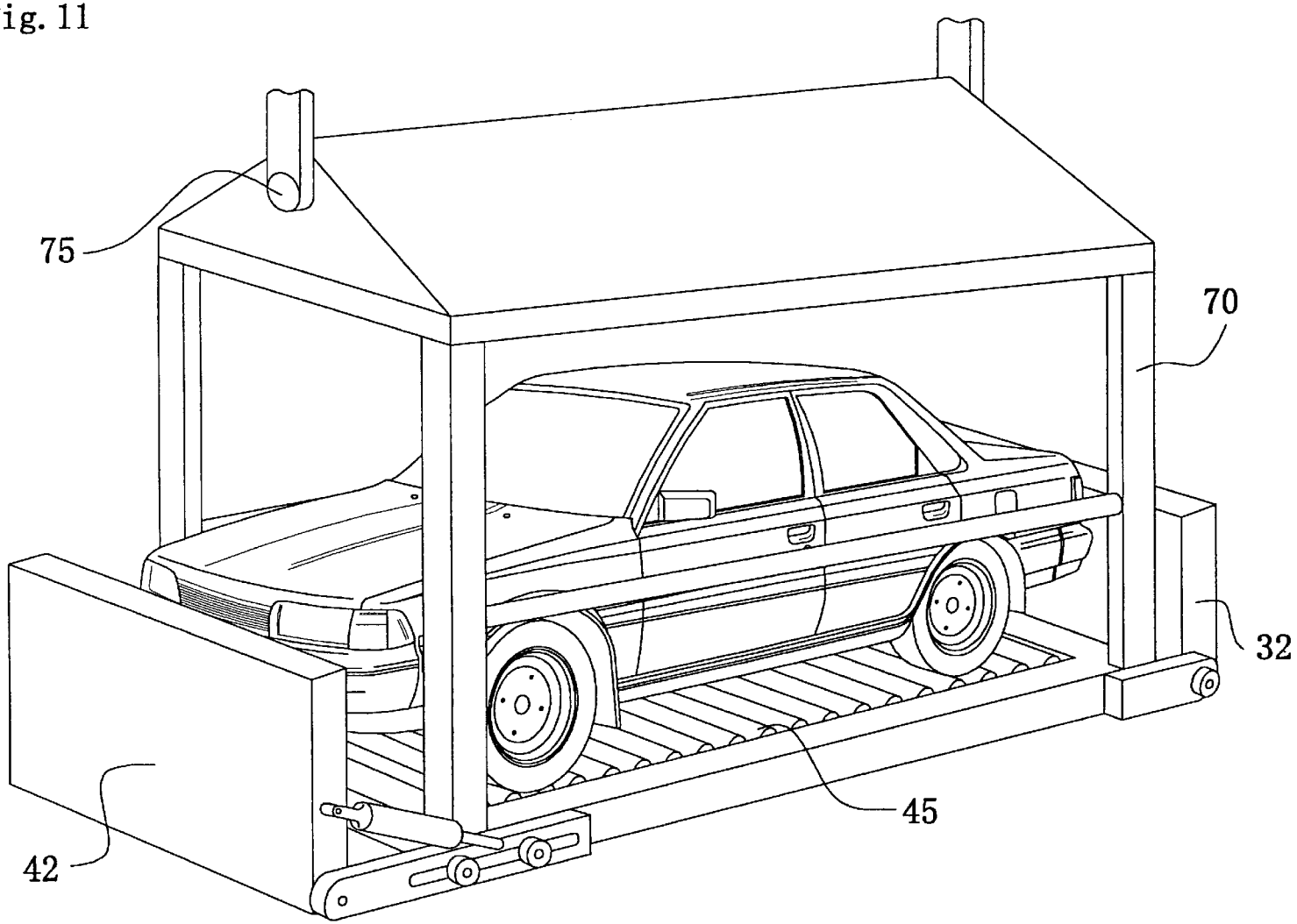
FIG. 11 is yet another support mechanism for use in the amusement park.

Rides such as the Ferris wheel 10 and the swing 12 require a car support mechanism 25 such as that depicted in FIG. 11. The car support mechanism 25 depicted in FIG. 11 includes the rollers 45, the front and rear gates 42 and 32 and a support structures 70 and 75 which allow for the car V to be lifted up. For instance, in the swing ride 12, the cars would be driven onto the platforms of the car support mechanism 25 depicted in FIG. 11, then the central support of the swing ride 12 moves upward, the car support mechanisms are lifted off the ground and swung slowly around. The Ferris wheel 10, on the other hand, lifts the car support mechanisms off the ground as the Ferris wheel rotates.

Figure 12:
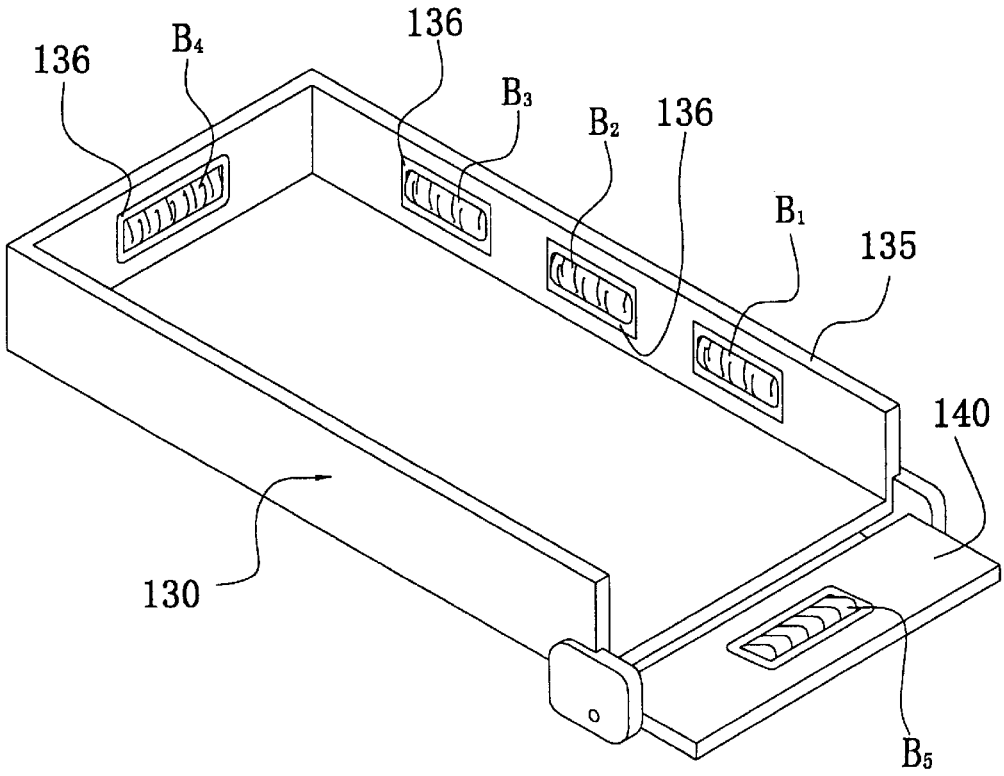
FIG. 12 is a perspective view of yet another support mechanism for use in the amusement park, where the support mechanism includes inflatable support bags.
Figure 13:
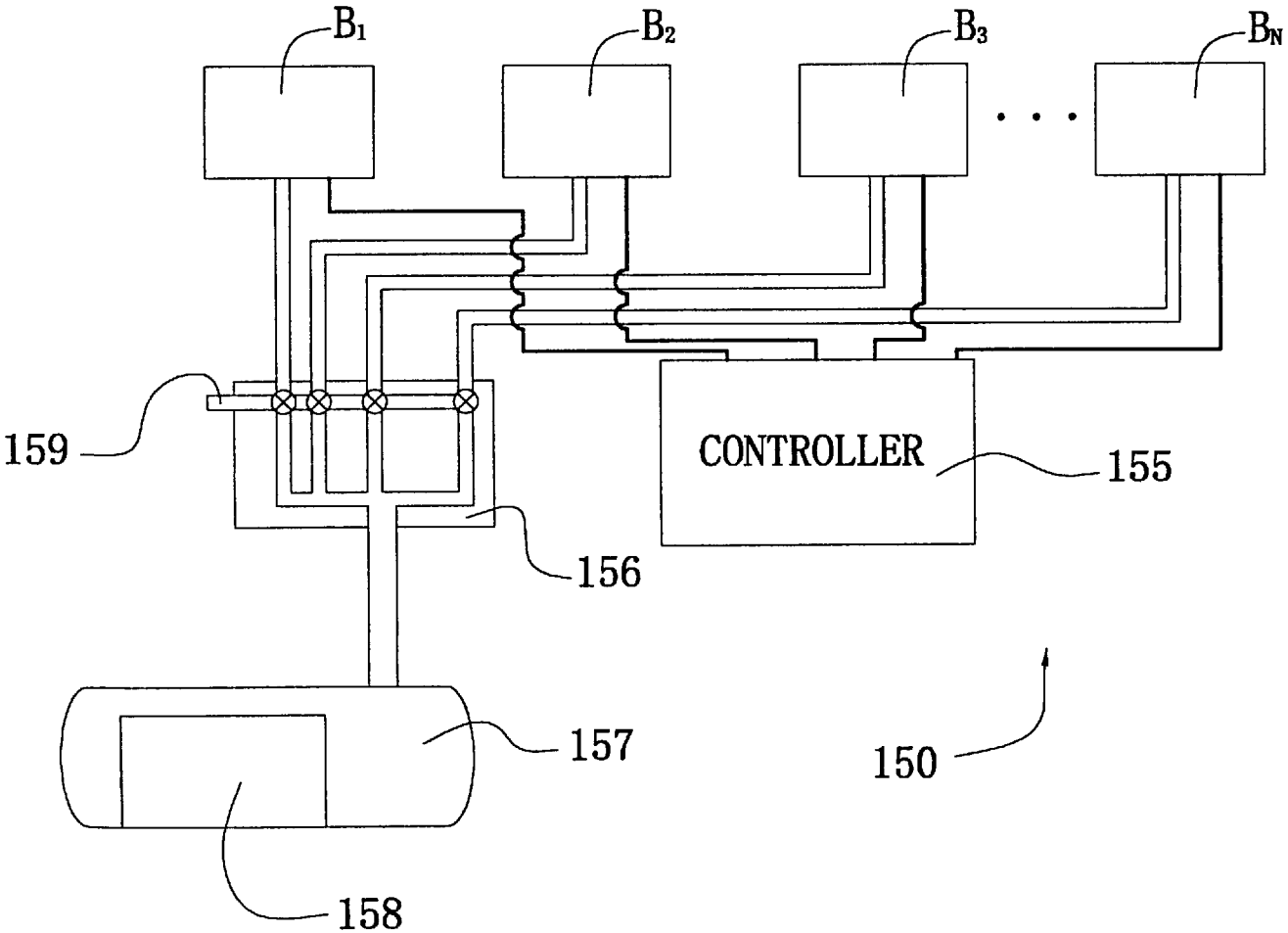
FIG. 13 is a control system for controlling the inflatable support bags depicted in FIG. 12.
Figure 14:
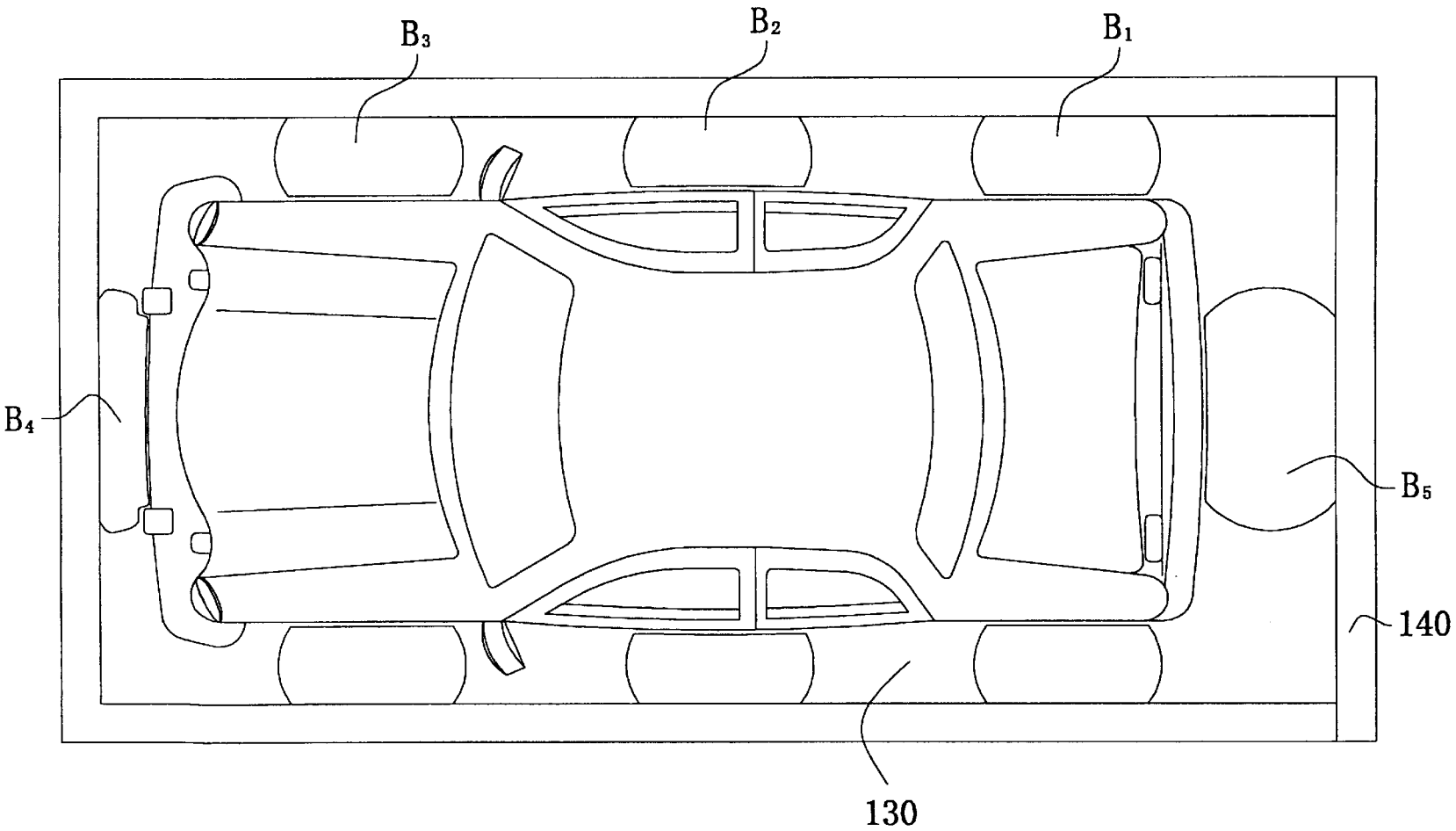
FIG. 14 is a top view of the support mechanism depicted in FIG. 12, with an automotive vehicle being restrained therein.

Another embodiment of a car support mechanism is depicted in FIGS. 12, 13 and 14. The car support mechanism includes a platform 130. The platform 130 includes upright sides 135 on three sides thereof. The sides 135 are formed with a plurality of recesses 136. Within each recess 136 is an inflatable bag, such as the bags $B_1$, $B_2$, $B_3$, $B_4$ and $B_5$. There are additional bags, not shown in FIG. 12, as is explained in greater detail below with regard to FIG. 14. The bags $B_1$, $B_2$, $B_3$, $B_4$ and $B_5$ are sealed bags made of a durable air tight material and may include various plies in order to provide an air tight seal. The outer ply of the bags $B_1$, $B_2$, $B_3$, $B_4$ and $B_5$ is soft so that it is unlikely that the outer surface of the bags $B_1$, $B_2$, $B_3$, $B_4$ and $B_5$ can harm painted surfaces, such as the surfaces of an automobile.

Although not shown in FIG. 12, the bags $B_1$, $B_2$, $B_3$, $B_4$ and $B_5$ are connected to an inflation control system 150, as is depicted in FIG. 13. The inflation control system 150 includes a controller 155 that is connected to a valve/sensor control 156. The valve/sensor control 156 is in turn connected to a compressed air tank 157 that is supplied with compressed air from a compressor 158.

The valve/sensor control 156 includes a plurality of valves, each valve for selectively supplying compressed air to the bags $B_1$, $B_2$, $B_3$ through $B_N$. The bag $B_N$ is not depicted but is rather a representation of all the inflatable bags that may be included in the present invention. Each valve is controlled by the controller 155. Each valve includes a sensor (not shown) for sensing the air pressure in each bags $B_1$, $B_2$, $B_3$ through $B_N$.

As is shown in FIG. 14, the car support mechanism depicted in FIG. 12 includes a total of eight (8) inflatable bags, including bags $B_1$, $B_2$, $B_3$ and $B_5$. Each bag is inflatable to a predetermined pressure for securing an automobile on the platform 130.

The platform 130 includes a gate 140 on which the bag $B_5$ is secured. With the gate 140 in a lowered position, as is depicted in FIG. 12, an automobile may be driven onto the platform 130, as is shown in FIG. 14. Once the automobile is in position on the platform 130, the gate 140 is raised and an operator may manipulate controls on the controller 155 causing the bags, including bags $B_1$, $B_2$, $B_3$ and $B_5$ to inflate. In an inflated condition, the bags engage the sides, front and rear of the automobile securely retaining the automobile on the platform 130.

The sensors (not shown) associated with the valves in the valve/sensor control 156 may be used to monitor the pressure within the bags $B_1$, $B_2$, $B_3$ and $B_N$. The pressure within the bags provides an indication of engagement with the automobile. Therefore, if the bags are inflated to a predetermined air pressure, it can be determined that the automobile is secured on the platform 130. The amusement ride utilizing the platform 130 can safely commence with the automobile safely in position on the platform 130. After completion of the ride, the operator may manipulate controls (not shown) on the controller 155 to release the pressure from the inflatable bags out an exhaust 159 so that the bags may retract into the recesses 136, the gate 140 may drop down and the automobile drive out to the next ride.

As should be apparent from FIG. 14, the doors of the automobile are secured against opening by the inflatable bags in contact with the sides of the automobile, further adding to the safety of the car support mechanism depicted in FIGS. 12, 13 and 14.

Figure 15:
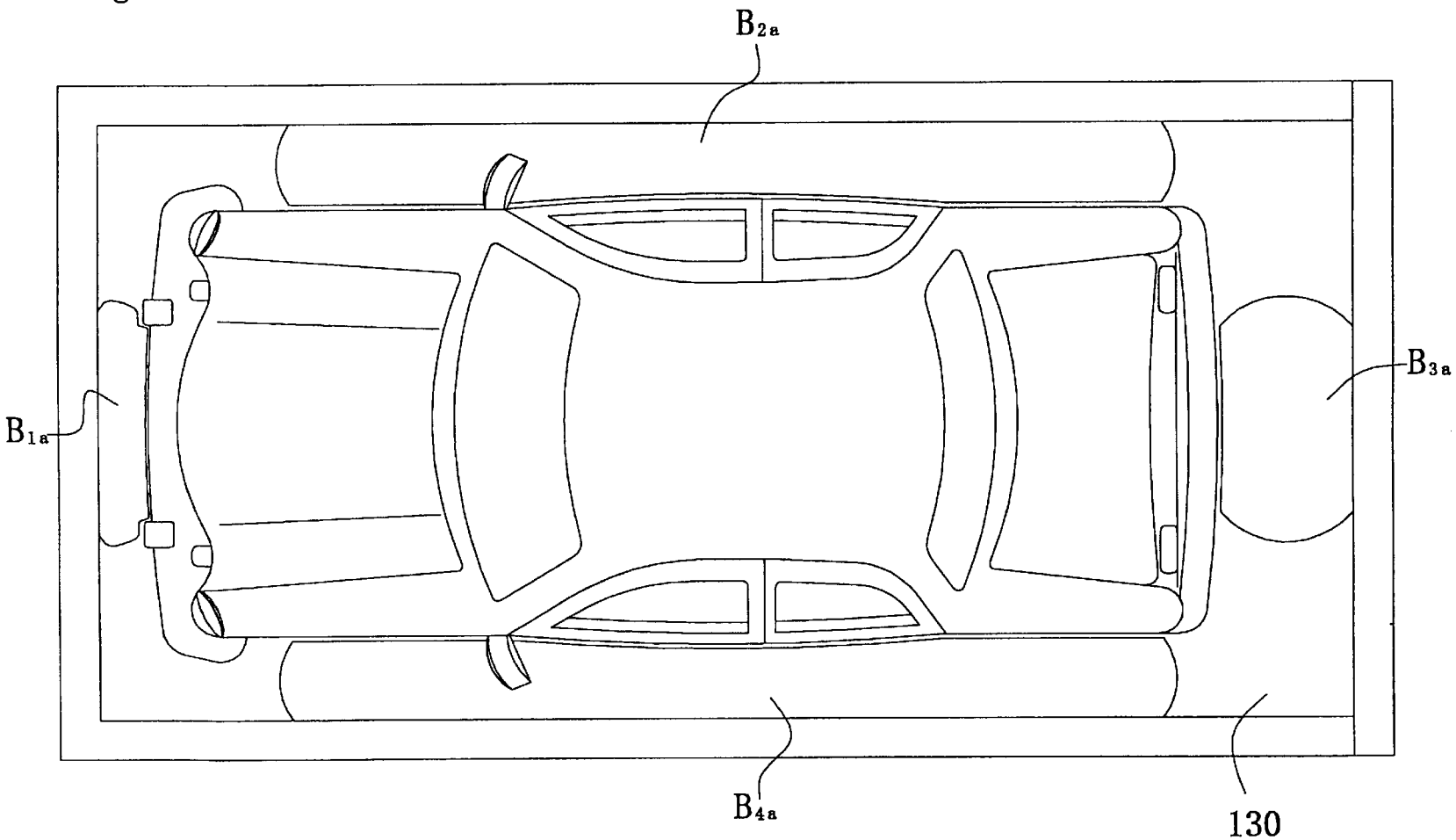
FIG. 15 is a top view of an alternate configuration of the support mechanism depicted in FIG. 12.

It should be understood that the platform 130 may be provided with any of a variety bag configurations. For instance, as is shown in FIG. 15, there may only four (4) bags, bags $B_{1a}$, $B_{2a}$, $B_{3a}$ and $B_{5a}$ on the platform 130. Other combinations of inflatable bags and sizes of inflatable bags are of course possible.

Figure 16:
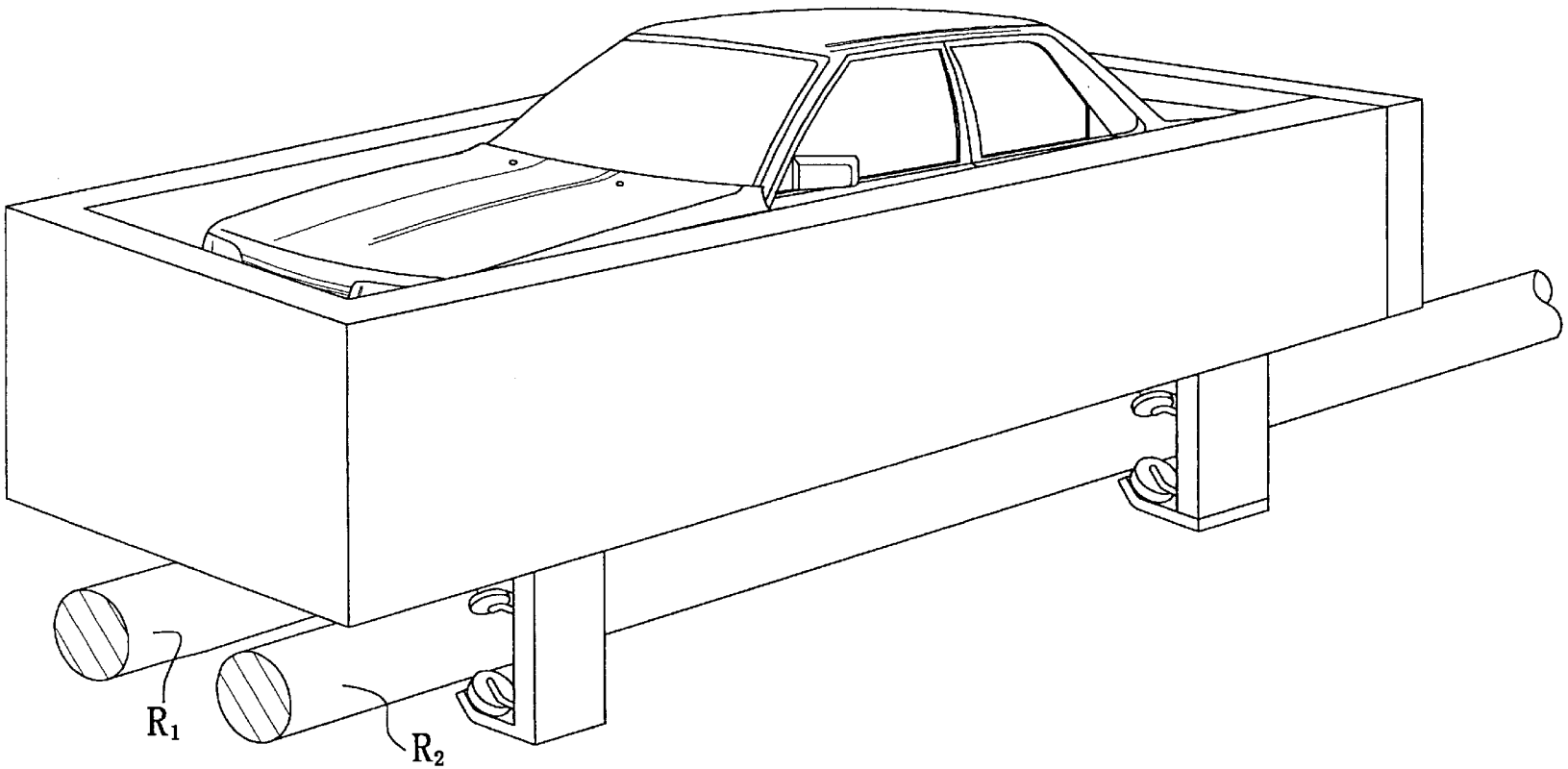
FIG. 16 is a perspective view of the support mechanism depicted in FIG. 12 having track support on an underside thereof.
Figure 17:
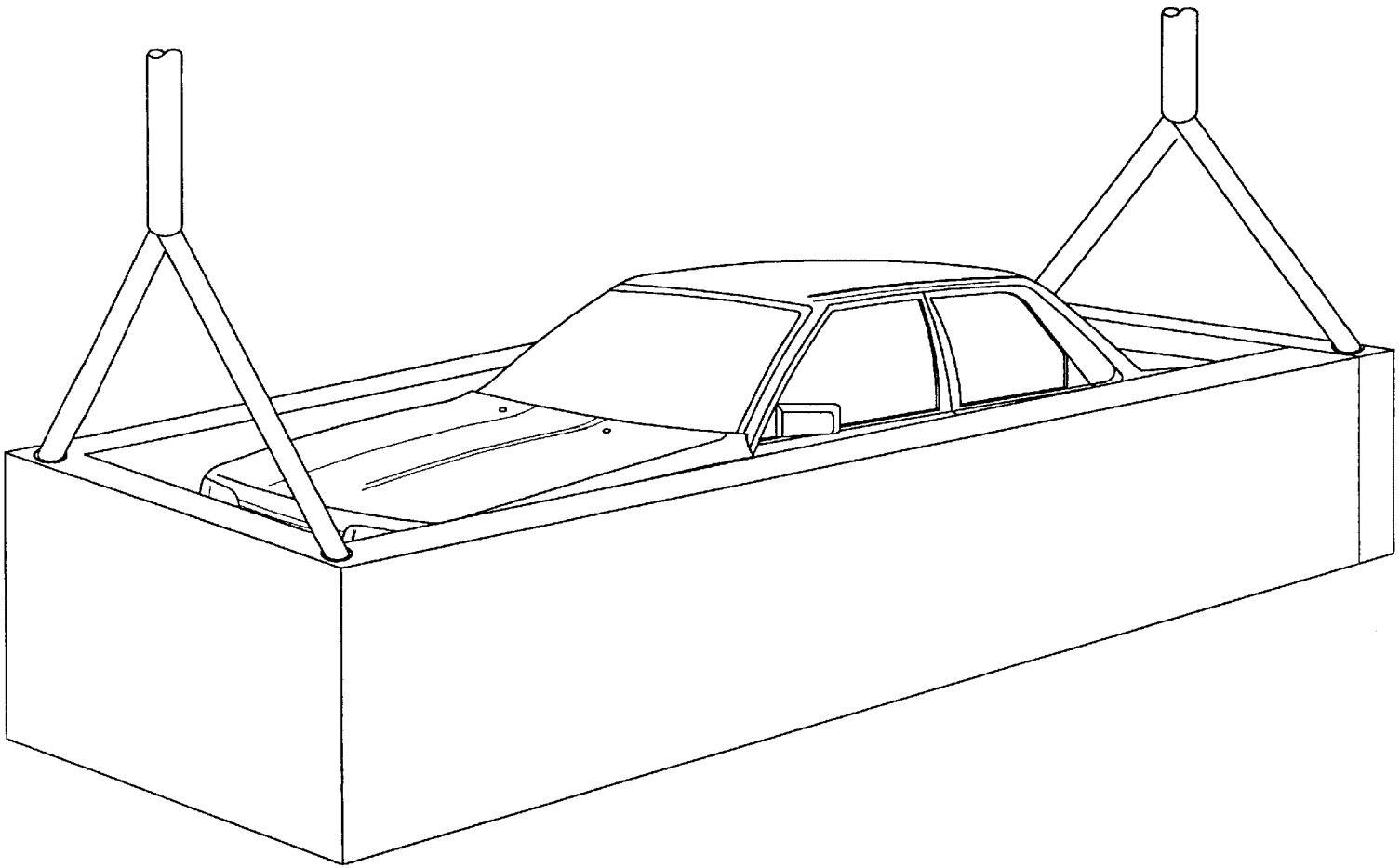
FIG. 17 is a perspective view of the support mechanism depicted in FIG. 12 having support on an upperside thereof.

The platform 130 may be configured in a variety of ways for use on a variety of amusement rides. For instance, as shown in FIG. 16, the platform 130 may be configured for a ride which supports the platform 130 on rails $R_1$ and $R_2$. Or, alternatively, the platform 130 may be supported from above, as depicted in FIG. 17, for use on the swing 12 or the Ferris Wheel 10.

Figure 18:
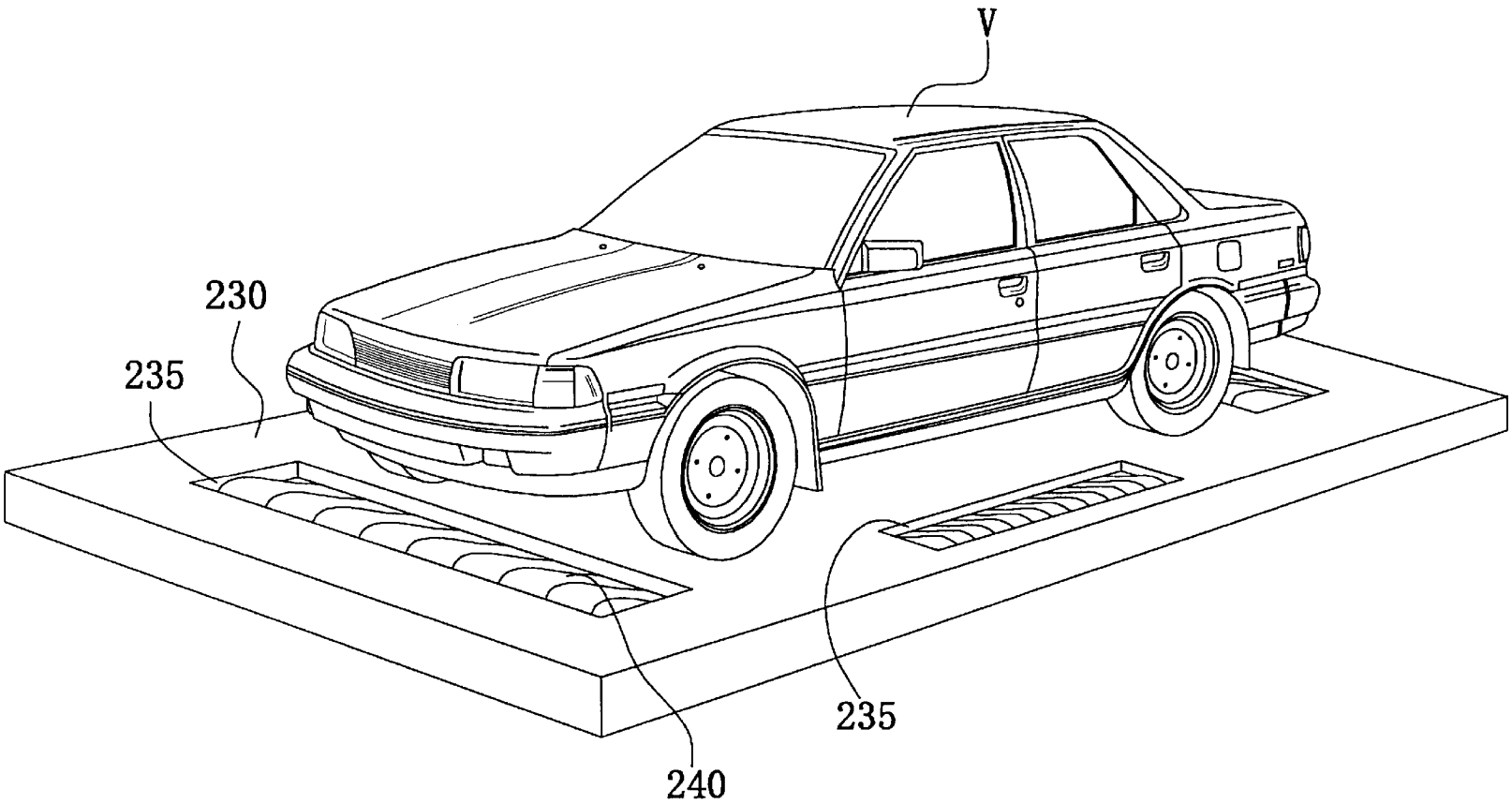
FIG. 18 is a perspective view of still another support mechanism in accordance with the present invention, where the support mechanism includes inflatable bags.
Figure 19:
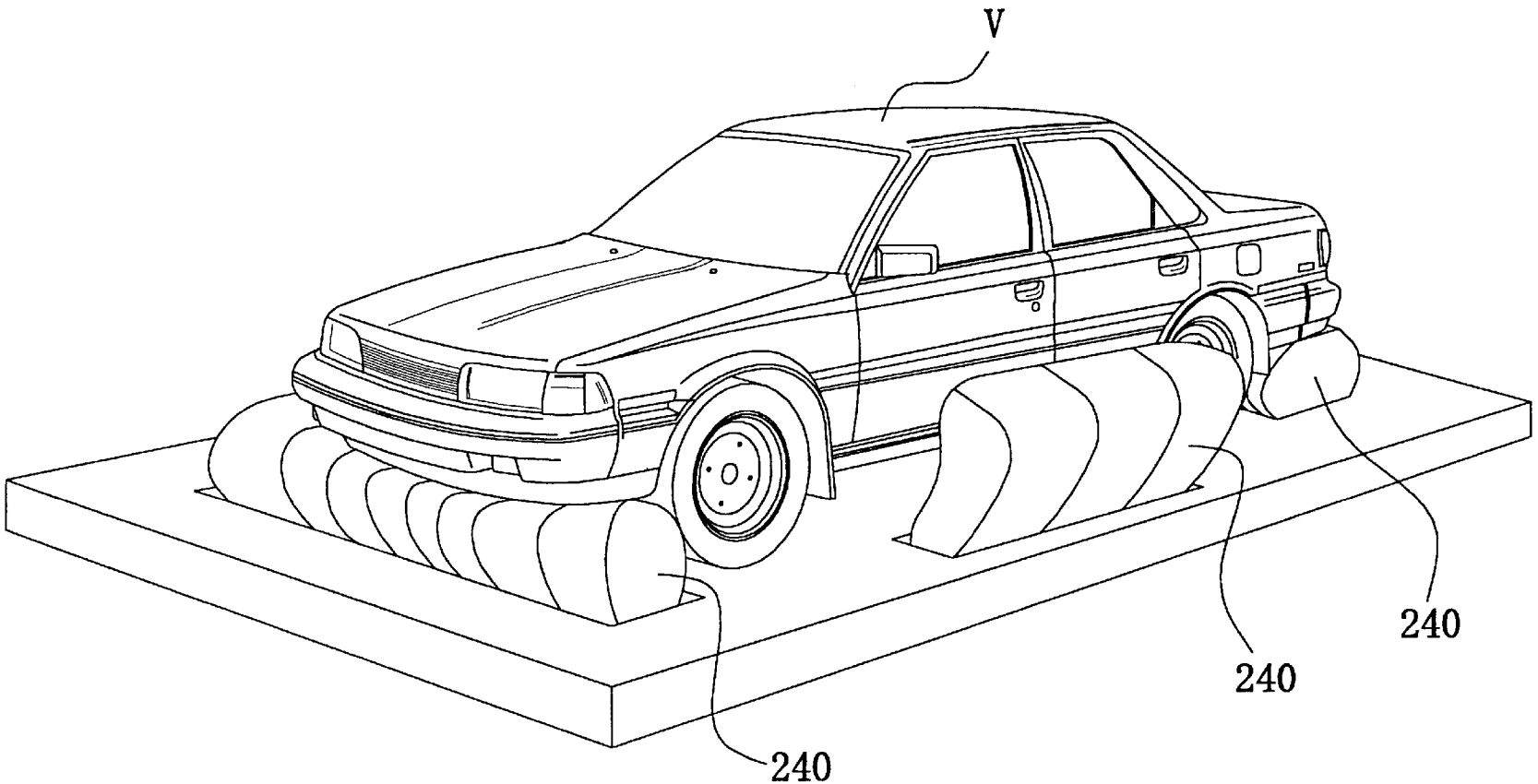
FIG. 19 is a perspective view of the support mechanism depicted in FIG. 18, with the inflatable bags in an inflated state.

Yet another embodiment of the present invention is depicted in FIGS. 18 and 19. A support mechanism having a platform 230 is formed with a plurality of recesses 235. In each recess 235 there is disposed an inflatable bag 240. The inflatable bags 240 are similar to the bags $B_1$, $B_2$, $B_3$ through $B_N$ described above. Although not shown in FIGS. 18 and 19, a control system, such as the control system depicted in FIG. 13 is used to control the inflation condition of the bags 240.

As is shown in FIG. 19, the bags 240 are inflatable for securing an automotive vehicle V to the platform 230. It should be appreciated that the platform 230 depicted in FIGS. 18 and 19 is provided with at least four bags 240, although only three bags 240 are visible. One bag 240 is positioned on each side of the platform 230 corresponding to sides of the automotive vehicle V. One bag 240 is positioned forward from front wheels of the automotive vehicle V and one bag 240 is positioned rearward from rear wheels of the automotive vehicle V.

The positioning of the bags 240 on the platform 230 is such that the wheels of the automotive vehicle V are blocked against rotation with the bags 240 in an inflated state. Further, the bags 240 on either side of the automotive vehicle V are positioned to engage doors of the automotive vehicle V thus preventing the doors from opening with the bags 240 in an inflated state, as shown in FIG. 19.

Thus, the support mechanism depicted in FIGS. 18 and 19 provides a reliable and safe way to restrain a vehicle on the platform 230 in a simple manner.

It should be appreciated that with the bags 240 in an uninflated state, the bags 240 retract into the recesses 235. The bags 240 are may be made of any of a variety of materials making in possible for the car to roll over the bags 240 when entering the platform 230 and leaving the platform 230.

In order to retract into the recesses 235, the bags 240 may be elastic or may have an elastic element or elements formed on an outside surface or within the bags 240.

Figure 20:
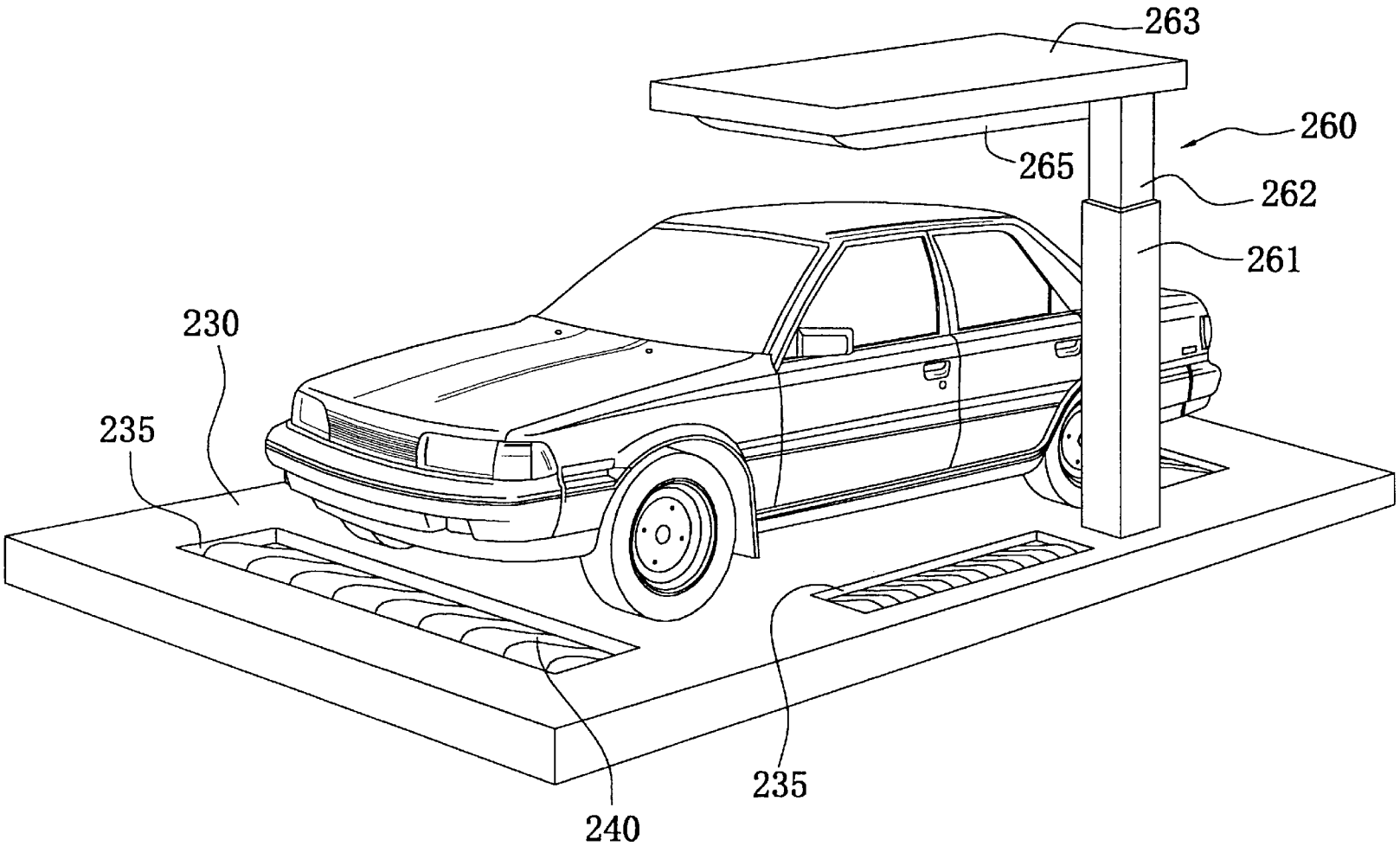
FIG. 20 is a perspective view of a support mechanism similar to that depicted in FIGS. 18 and 19 where the support mechanism further includes an upper support mechanism.

For some amusement park rides, such as the roller coaster, it may be necessary to secure an automotive vehicle from above. In other words, upward movement of the vehicle relative to the platform must be avoided for safety reasons. In such a circumstance, it may be desirable to include a means for holding the vehicle against the surface of the platform of the support mechanism. Such a means is included in the support mechanism depicted in FIG. 20. The support mechanism depicted in FIG. 20 is generally the same as the support mechanism depicted in FIGS. 18 and 19, except that the upper support mechanism 260 is fixed to the platform 230.

The upper support mechanism 260 includes an upright support 261 fixed to the platform 230, a telescoping member 262 that extends upward from the upright support 261 and a support structure 263 which is fixed to the telescoping member 262. On a lower surface of the support structure 263 is a cushion 265. However, the cushion 265 could alternatively be an inflatable bag. The telescoping member 262 may be moved up and down by control means (not shown) such as a crank lever, a hydraulic or pneumatic cylinder or other such device. By moving the telescoping member 262, the cushion 265 may be brought into engagement with the roof of the automotive vehicle V, thus securing the automotive vehicle V against movement up and down relative to the platform 230.

The upper support mechanism 260 is not limited to the structure as shown. For instance, the upper support mechanism 260 could be used with any of the embodiments of the present invention. Further, the upper support mechanism 260 is not limited to a single upright support member. In some applications it may be desirable to utilize several support members in the upper support mechanism 260. Further, the telescoping member 262 need not be used. Rather the support structure 263 may be directly fixed to the upright support 261 and an inflatable bag may be used instead of a cushion. As well, a sensor may be employed with a control system for automatically sensing the height of the automotive vehicle V and positioning the cushion 265 against the roof of the automotive vehicle V.

Cable Driven Ride

In another embodiment of the present invention depicted in FIGS. 21A–30, a cable driven ride is configured to support and move a plurality of carriages, each carriage able to support a motorized passenger vehicle. The cable driven ride may be used in, for instance, environmentally sensitive areas where the building of roads would intrude upon the local environment. Since people love to view nature from the comfort of their own car, the cable driven ride in accordance with the present invention provides a means for people to enjoy a ride through a valley or about a mountain side paradise without a road intruding upon the natural beauty of the scene.

Figure 21A:
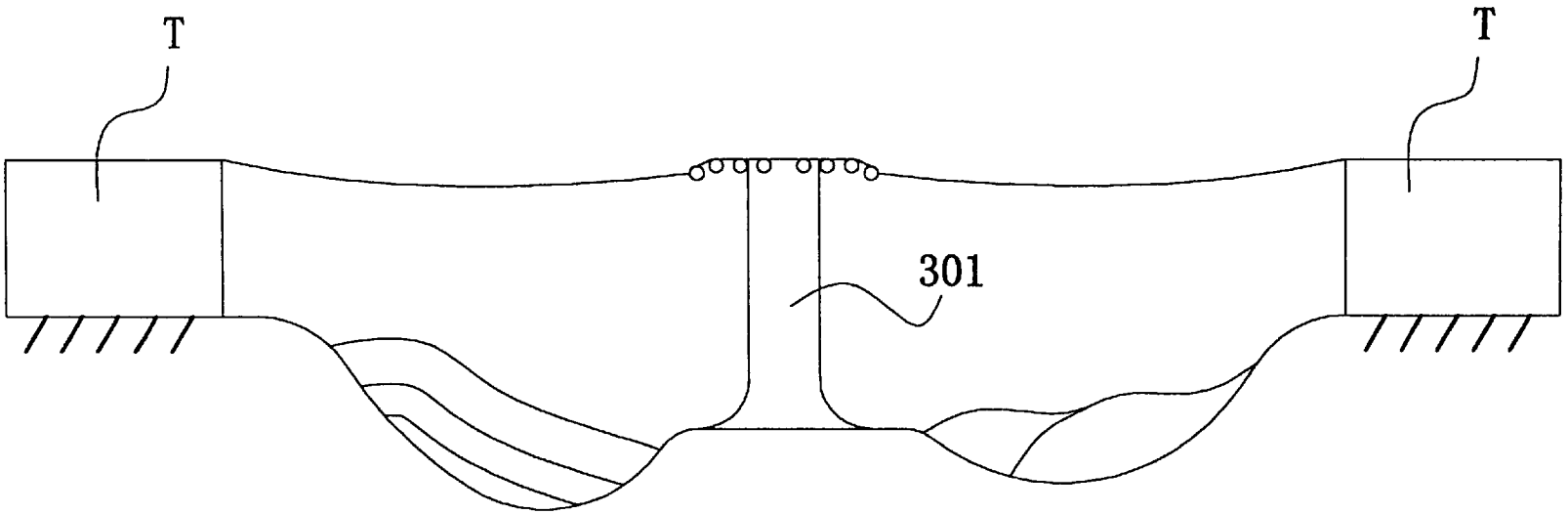
FIG. 21A is a side view of a cable driven ride in accordance with the present invention.
Figure 21B:
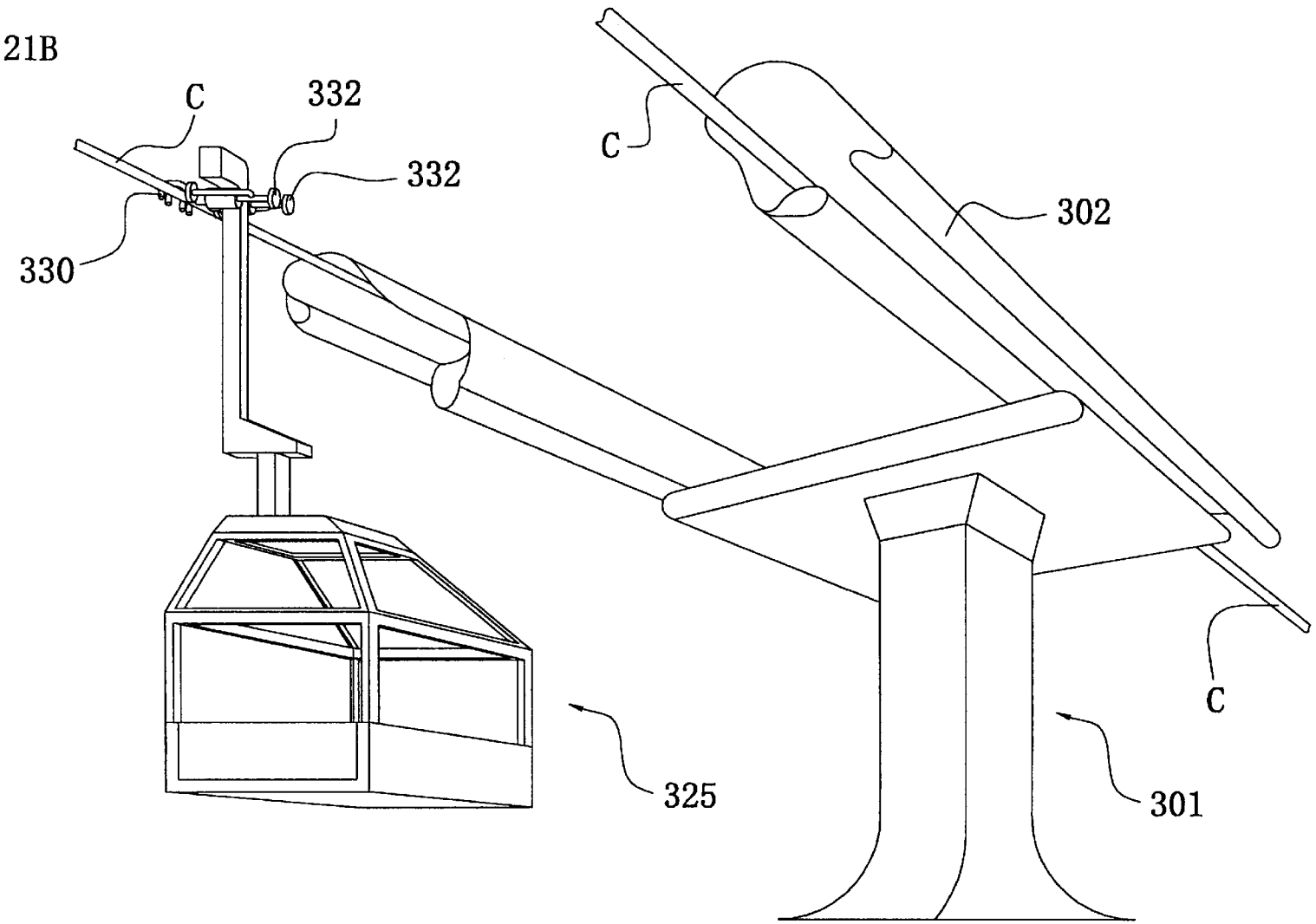
FIG. 21B is a perspective view of the cable driven ride that moves carriages, each carriage carrying a motorized passenger vehicle.

As shown in FIG. 21A, the cable driven ride includes two terminals T and at least one tower 301, although a plurality of towers 301 may be utilized. Each tower includes rollers that may be protected by a cover 302, as shown in FIG. 21B, the rollers supporting a cable C and allowing the cable C to move with respect to the tower 301 as the cable is pulled between the terminals T. The cable C extends between a plurality of the towers 301 over natural terrain. For instance the towers 301 may be spaced apart by a distance of hundreds of meters with the cable extending therebetween. The cable is moved between adjacent towers 301 such that the passenger vehicle moves above a scenic view.

Figure 22:
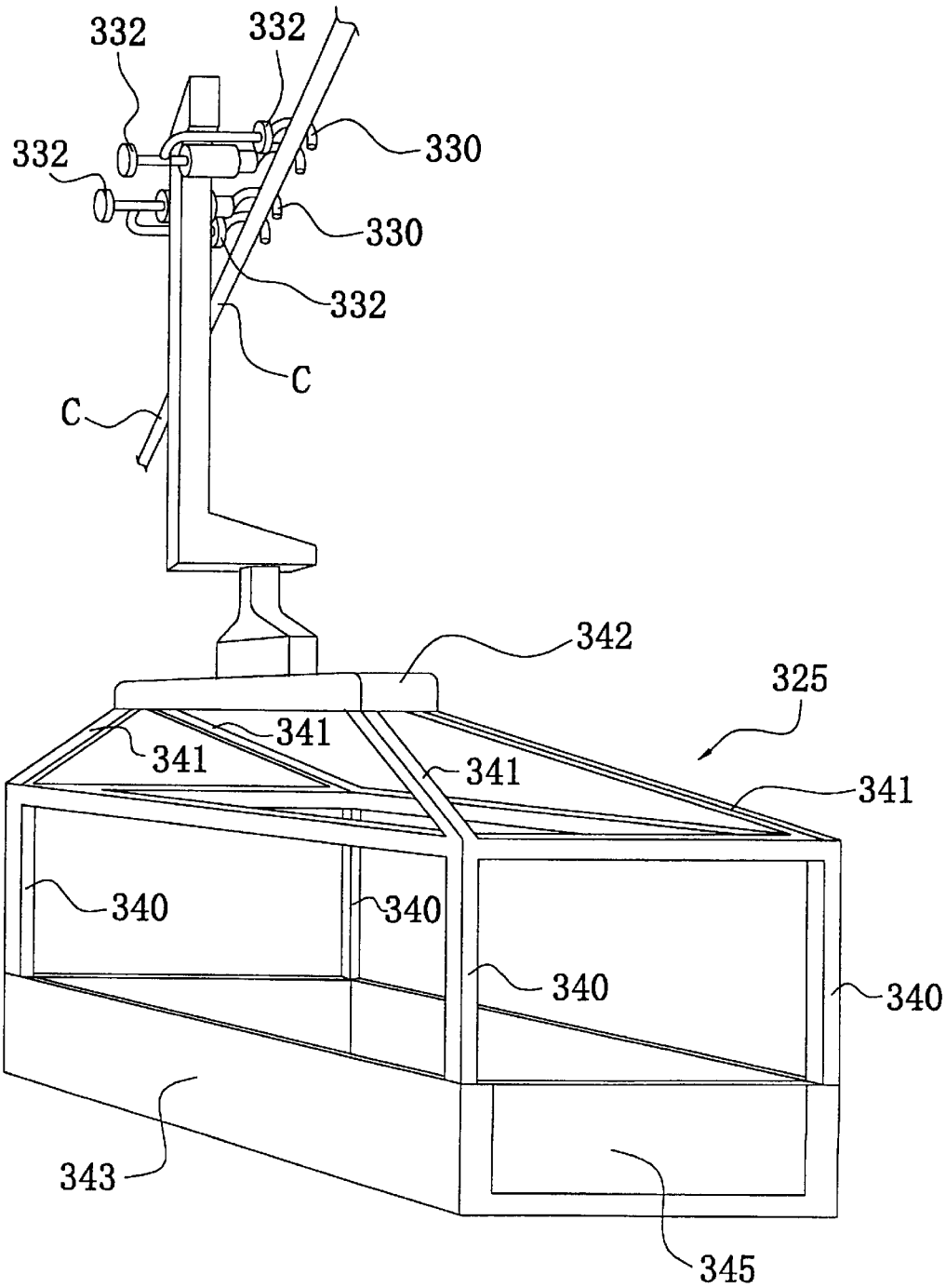
FIG. 22 is perspective view of a carriage supported on a cable of the cable driven ride depicted in FIG. 21.
Figure 23:
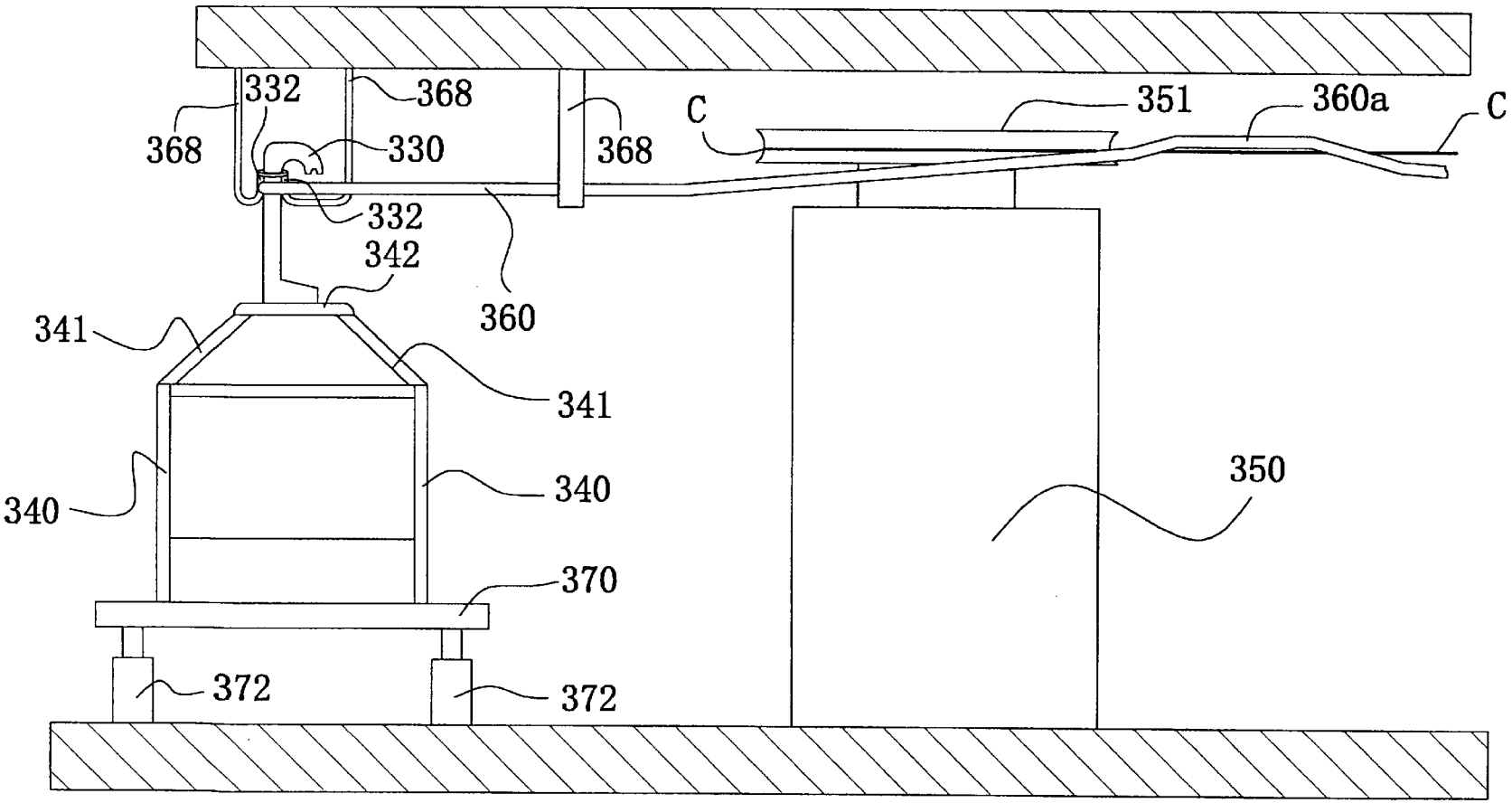
FIG. 23 is a side view of portions of a terminal of the cable driven ride depicted in FIGS. 21 and 22, the terminal for loading and unloading motorized passenger vehicles from a carriage.

The cable C supports a plurality of carriages 325, each carriage 325 able to support an automotive vehicle in much the same way as the support mechanisms discussed above with respect to FIGS. 1–20. Each carriage 325, as shown in FIGS. 21B, 22 and 23, includes at least one cable hook 330 that engages the cable C, thereby causing the carriages 325 to move along with the cable C. The cable hook 330 is part of a support assembly that also includes rollers 332. Tn the embodiment depicted in FIGS. 21B and 22, the support assembly includes four rollers 332 and two cable hooks 330.

Each of the carriages 325, as shown in FIGS. 21, 22 and 23, includes a frame structure that includes upright support beams 340, angled support beams 341 and a support plate 342, all rigidly fixed to one another. The lower portion of the frame structure includes three side panels 343 and one gate 345, described further below.

Figure 24:
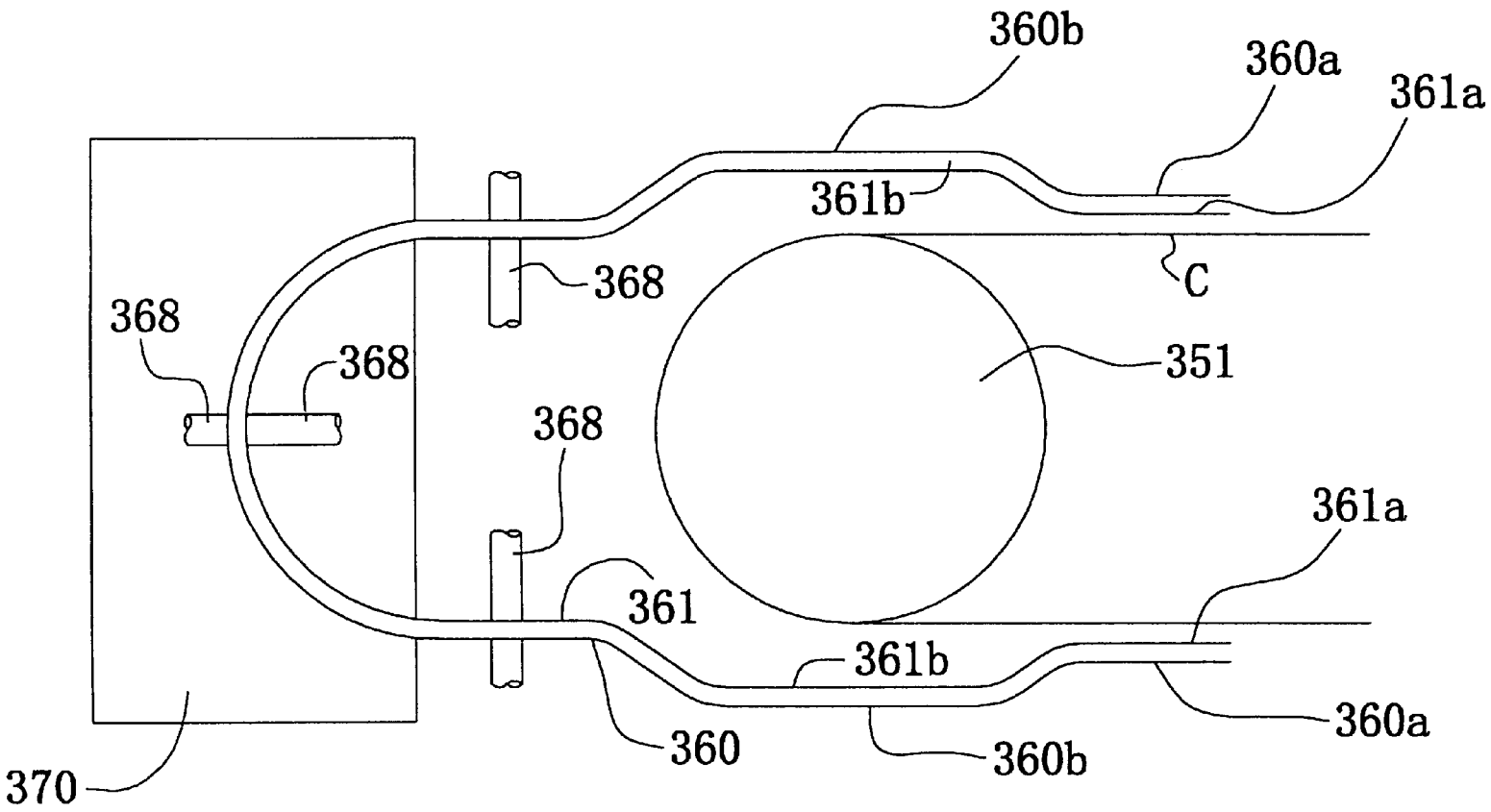
FIG. 24 is a top view of a portion of the terminal depicted in FIG. 23.
Figure 25:
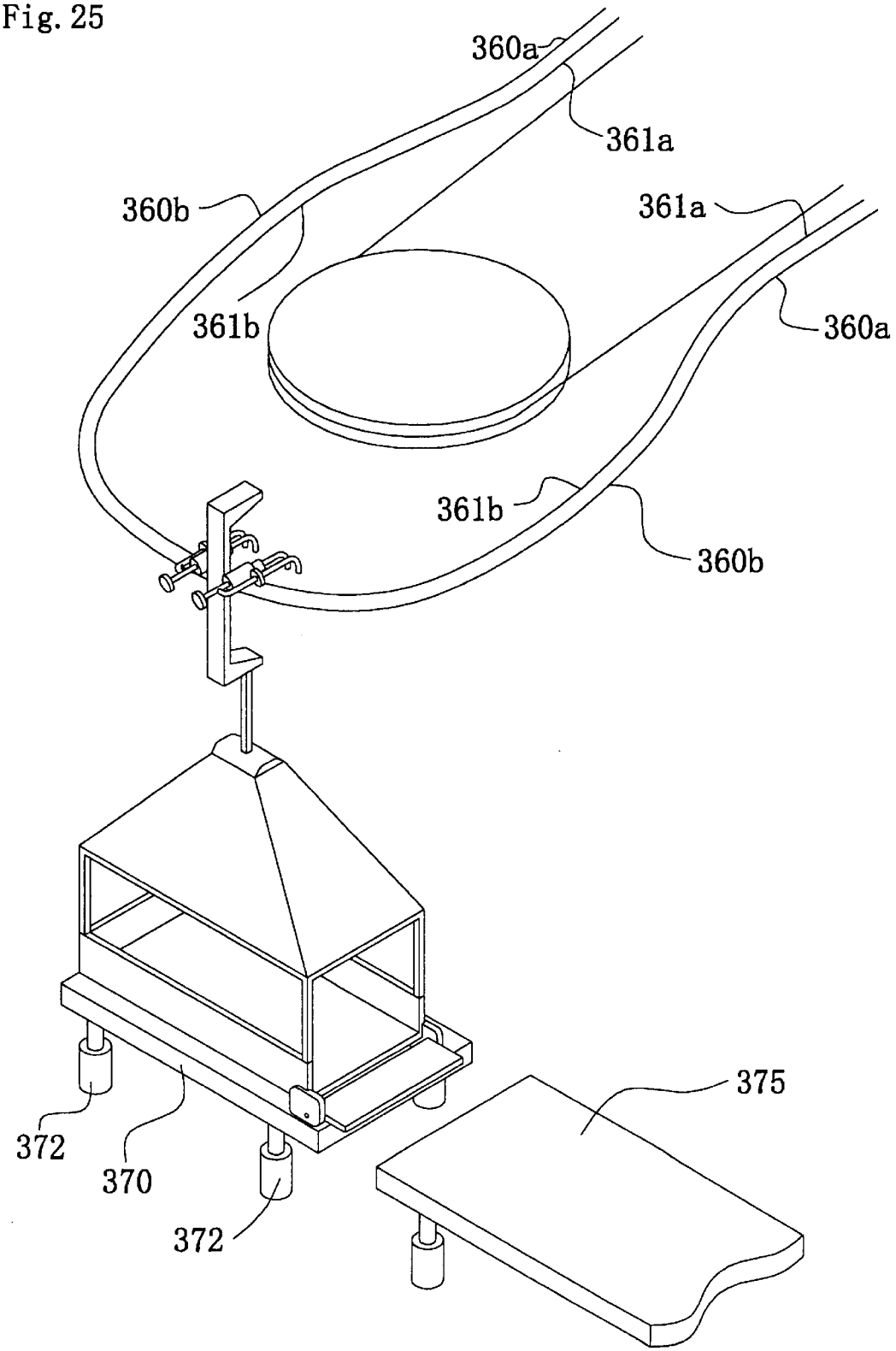
FIG. 25 is a perspective view of the portion of the terminal depicted in FIG. 24.

The cable driven ride includes at least one terminal T, depicted in FIGS. 23, 24 and 25. Each of the two terminals T supports the cable as is rotates in an endless belt manner between the two terminals T. As shown in FIG. 23, each of the terminals includes a motor 350 and a pulley 351 that engages the cable C. As the motor 350 rotates, the cable C is moved along the rollers of the towers 301 thereby moving the carriages 325.

The terminal is also provided with a pair of tracks 360 and 361 that have a U-shape, as shown in a top view in FIG. 24. As is shown in FIGS. 23 and 24, the tracks 360 and 361 are supported from above by supports 368. Portions 360*a* and 361*a* of the tracks 360 and 361 are positioned adjacent to the cable C at points along the cable C just before the cable C engages the pulley 351 and just after the cable C leaves the pulley 351. As can be seen in FIG. 23, the portions 360*a* (and 361*a*) are bent such that they are slightly higher than the cable C.

As each of the carriages 325 enter the terminal T, the cable hooks 330 engaged with cable C. Movement of the cable C causes the rollers 332 to eventually contact the tracks 360 and 361. As the carriage 325 continues to move toward the pulley 351 with the cable C, the rollers 330 begin to roll over the portions 360*a* and 361*a* of the tracks 360 and 361. Therefore, the carriage is lifted up such that the cable hooks 330 are lifted away from contact with the cable C. Momentum keeps the carriages 325 rolling on the tracks 360 and 361 until the tracks engage the portions 360*b* and 361*b*, which are bent away from the pulley, thereby causing the cable hooks 330 to be moved away from the cable C. The carriage 325 is then able to roll to the arcuate portion of the tracks 360 and 361 above a platform 370.

The platform 370 is supported by a plurality of cylinders 372 that allow upward and downward movement of the platform 370. The cylinders 372 may be either hydraulic, pneumatic or electric devices which provide controllable movement of the platform 370.

Once the carriage 325 has moved under the platform 370, the platform is raised to support the carriage 325 to prevent it from moving as a motorized passenger vehicle is moved in and out of the carriage 325. With the platform 370 supporting the carriage 325, the gate 345 may then be lowered and a ramp 375 shown in FIG. 25 may be moved to a position adjacent to the platform 370 and gate 345 to allow a motorized passenger vehicle to move in or out of the carriage 325. After a motorized passenger vehicle has been loaded on to the carriage 325, the gate 345 may be closed, the ramp 375 moved out of the way, and the platform 370 lowered out of the way. Due to the presence of the rollers 332 being engaged with the tracks 360 and 361, the carriage 325 is easily pushed either by manual operators along the tracks 360 and 361 to the portions 360*b* and 361*b* of the tracks, and subsequently to the portions 360*a* and 360*b*.

Once the cable hooks 330 contact the cable C, the carriage 325 then moves with the cable C and the roller 332 become disengaged from the tracks 360 and 361.

It should be understood that FIG. 25 does not show the motor 350 or the supports 368 in order to provide greater clarity of the various features of the present invention.

It should also be understood that the carriage 325 described above is basically a cage which supports a motorized vehicle in the cable driven ride. There are many different sizes, shapes and configurations of motorized passenger vehicles and therefore, ideally, the carriages 325 should be able to accommodate as many different types of vehicles as possible. For that reason, several embodiments of the carriages 325 are contemplated.

Figure 26:
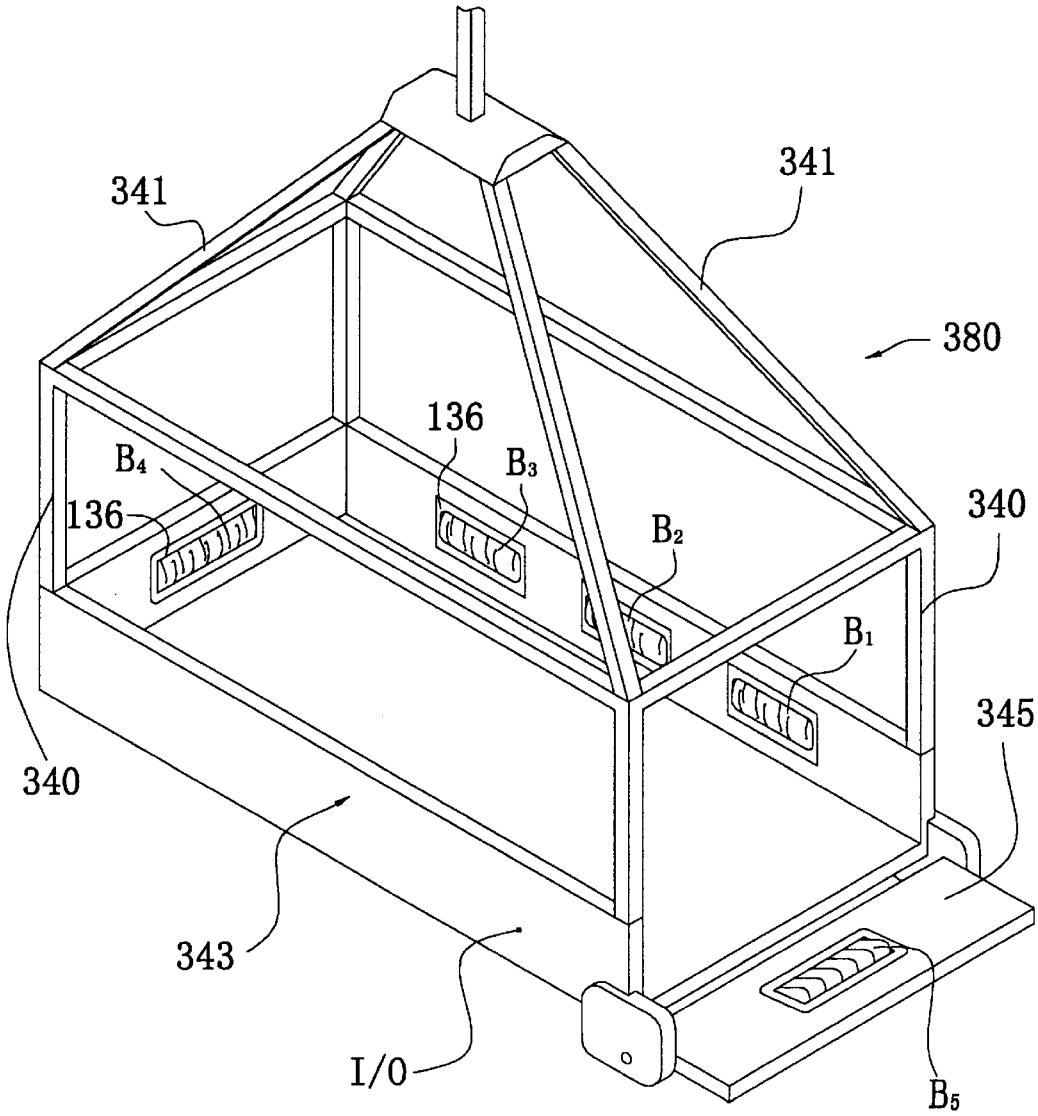
FIG. 26 is a perspective view of one embodiment of the carriage of the cable driven ride depicted in FIGS. 21–25.
Figure 27:
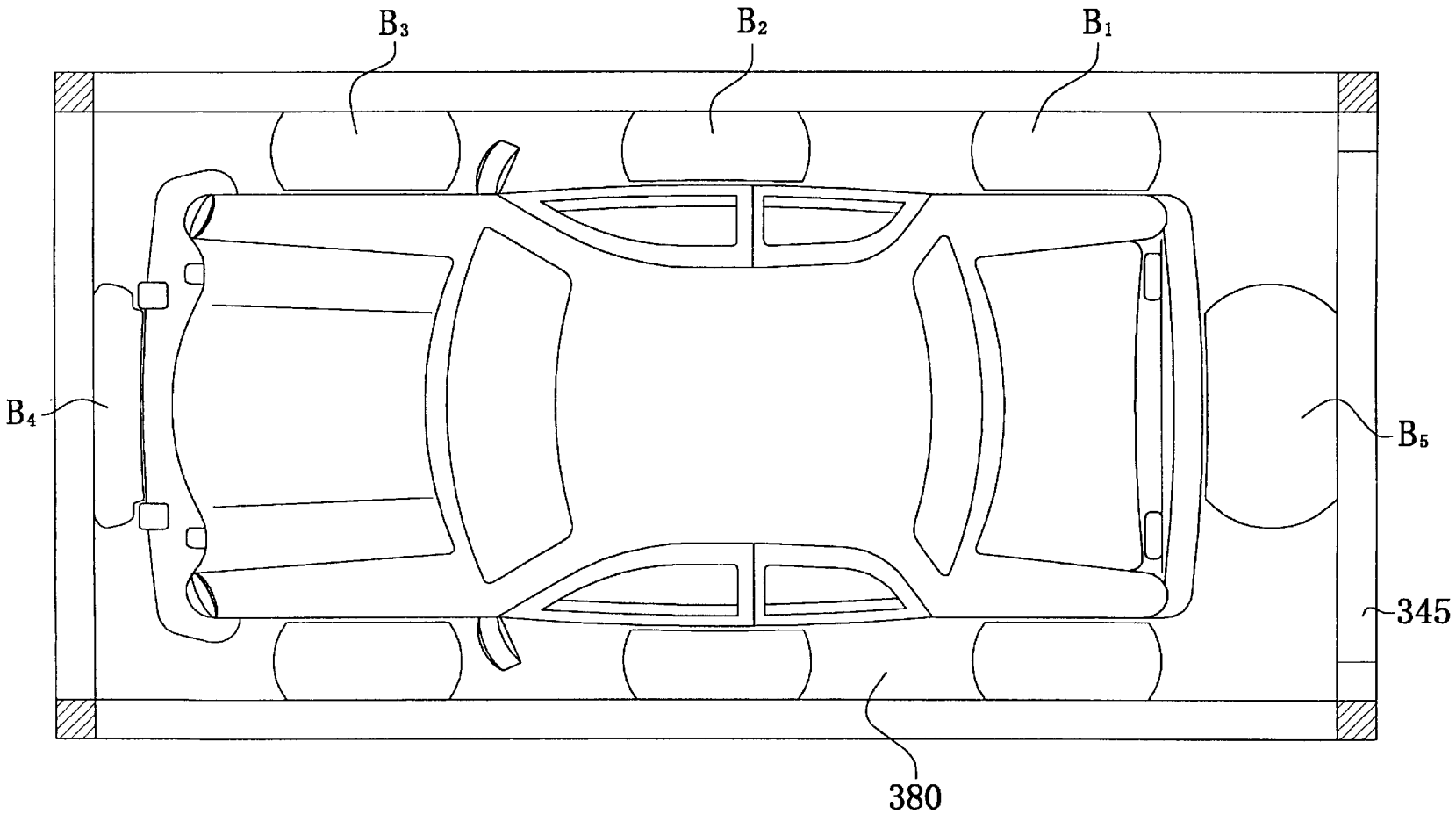
FIG. 27 is a fragmentary top view of the carriage depicted in FIG. 26.

One such carriage 380 is shown in FIGS. 26 and 27. The carriage 380 includes an open structure similar to the carriage 325. For instance the carriage 380 includes the supports beams 340 and 341, as well as the gate 345 and side panels 343. However, -the carriage 380 also includes a plurality of inflatable bags $B_1$, $B_2$, $B_3$ through $B_N$, similar to the bags described above with respect to FIGS. 12, 13 and 14. The bags $B_1$, $B_2$, $B_3$ through $B_N$ surround a motorized passenger vehicle, as shown in FIG. 27, thereby securing the motorized passenger vehicle within the carriage 380.

The bags $B_1$, $B_2$, $B_3$ through $B_N$ may be inflated by any of a variety of means. For instance, a single air inlet/outlet I/O may be provided on the carriage 380 and connected to each of the bags $B_1$, $B_2$, $B_3$ and $B_N$ via pressure tubes (not shown). An operator may inflate the bags using pressurized air before launching the carriage 380 on the cable C via the tracks 360 and 361. An air compressor (not shown) and air supply hose (not shown) are provided in the terminal adjacent -to the platform 370 for inflating the bags $B_1$, $B_2$, $B_3$ through $B_N$. The bags $B_1$, $B_2$, $B_3$ through $B_N$ are deflated by releasing the air pressure via the inlet/outlet I/O.

Figure 28:
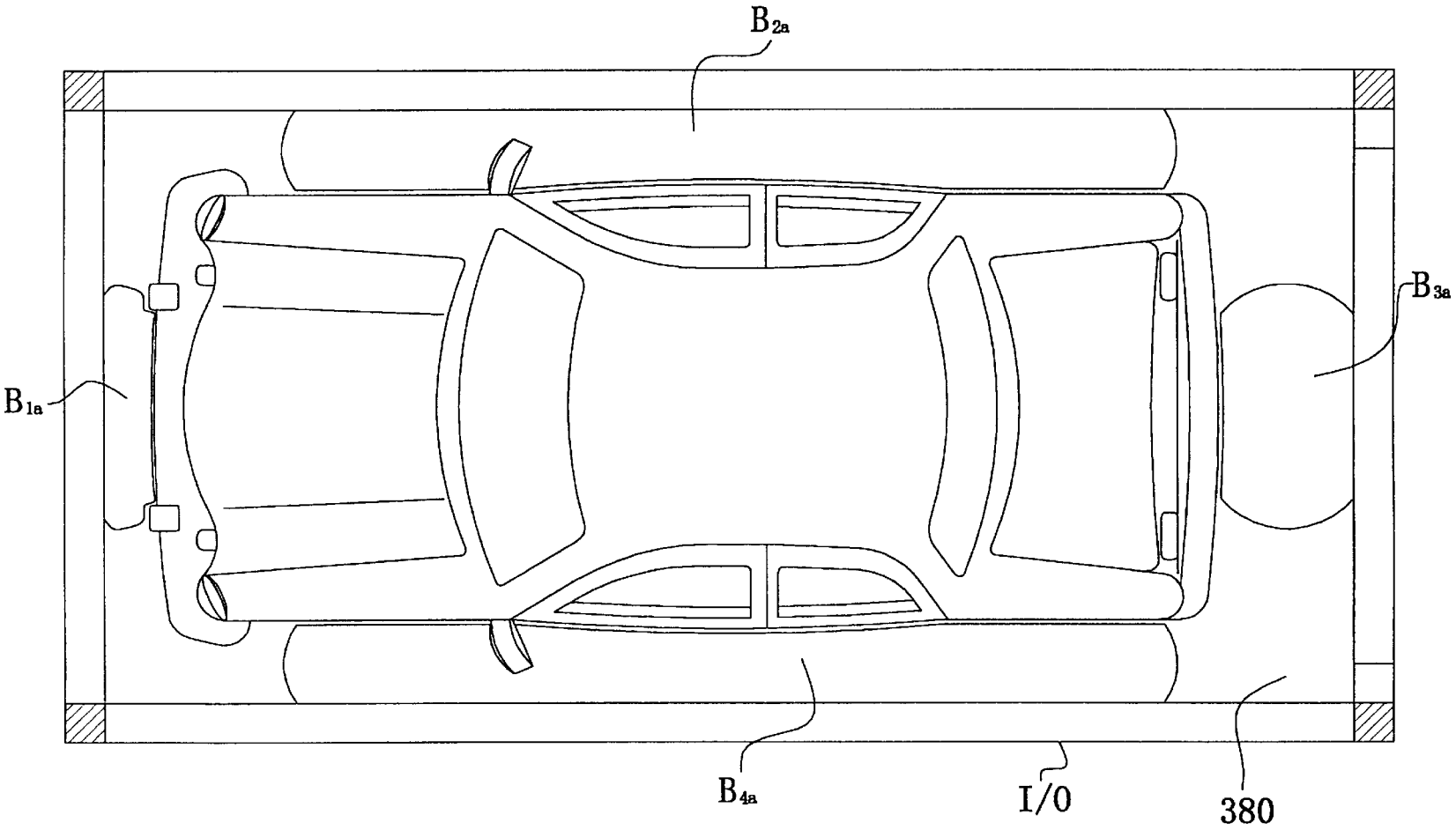
FIG. 28 is a fragmentary top view similar to FIG. 27 showing an alternate embodiment of the carriage depicted in FIG. 27.
Figure 29:
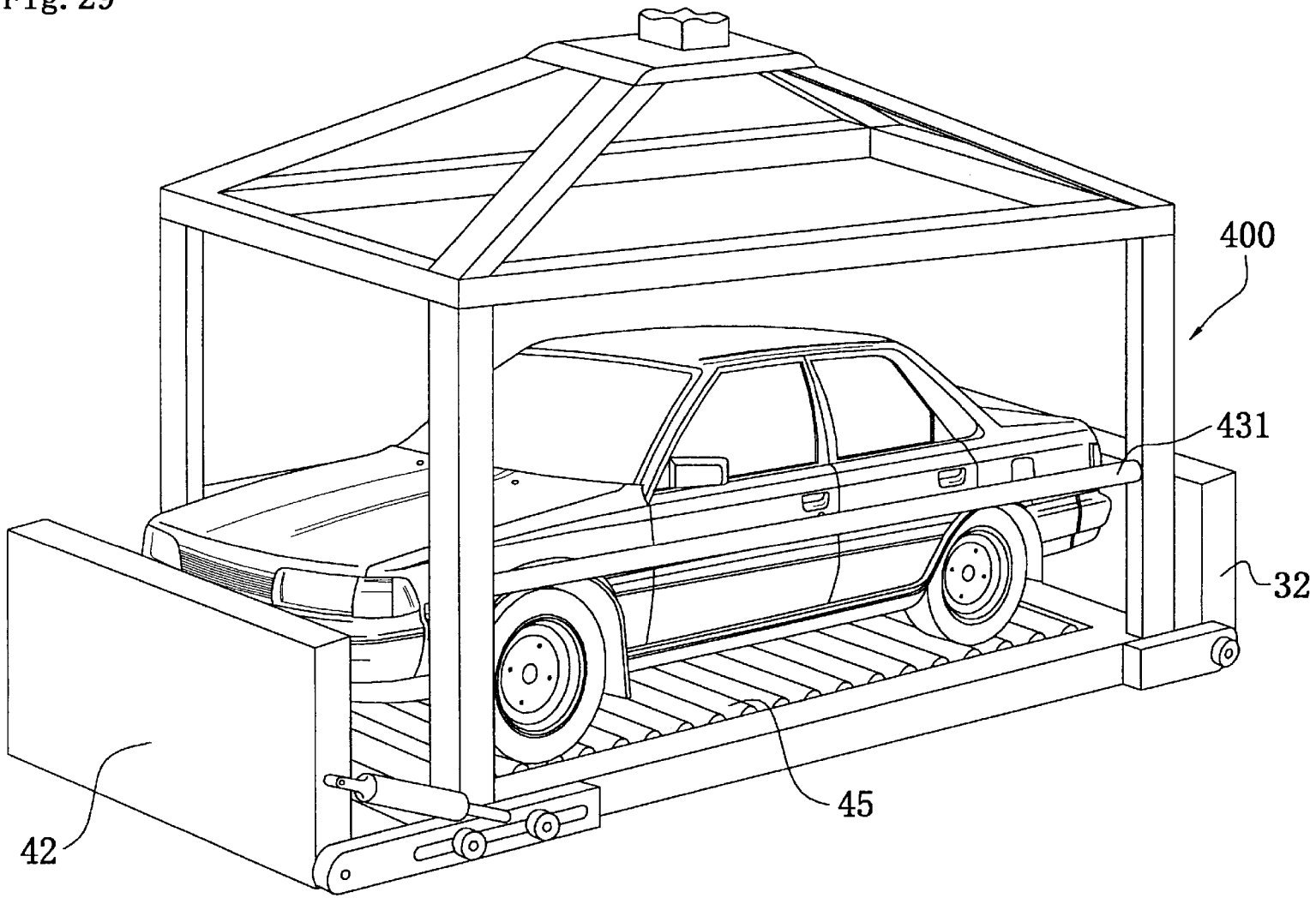
FIG. 29 is a fragmentary perspective view of another embodiment of the carriage of the cable driven ride.

Alternatively, the platform 380 may be provided with fewer bags, each bag being larger than the bags shown in FIG. 27. For instance, bags $B_{1a}$, $B_{2a}$, $B_{3a}$ , and $B_{4a}$ may be provided on the side panels of the platform 380 as shown in FIG. 28. The bags $B_{1a}$, $B_{2a}$, $B_{3a}$ and $B_{5a}$ may be inflated and deflated via an inlet/outlet I/O that is connected via pressure tubes (not shown) to each of the bags $B_{1a}$, $B_{2a}$, $B_{3a}$ and $B_{5a}$ A carriage 400 is also contemplated. The carriage 400 is depicted in FIGS. 29 and 20 and includes a gate 42 the car support mechanism includes a platform and support structure that includes a support bar 31 which may be made of a strong metal material coated with soft foam material to protect against contact with the motorized passenger vehicle. A swinging rear gate 32 is moveable up and down.

In the front portion of the platform there are two parallel sliding bars 35 (although only one bar 35 is visible). The sliding bar 35 is secured to the platform but may slide along the pins 36. The sliding movement of the bar 35 is limited by the length of an elongated groove 35*a*. Movement of the bar 35 is controlled by a pressure cylinder 40 that is secured at one end to the platform and secured to the bar 35 at the other end. A front gate 42 is pivotally mounted to the bar 35. Movement of the front gate 42 is controlled by a cylinder 43.

The cylinders 40 and 43 include a locking mechanism (not shown) such that after being put into position, if air pressure is reduced, the cylinders 40 and 43 are locked into position until air pressure within the cylinders is restored. In this manner, the cylinders 40 and 43 may only be moved when air pressure is supplied by an operator in the terminal. Therefore, while moving with the cable in the cable driven ride, the carriage 400 safely retains the motorized vehicle.

The platform 30 is further provided with a plurality of rollers 45. The rollers 45 are all generally parallel within the platform 30 and are freely rotatable. A braking mechanism (not shown) is mounted within the platform 30 for selectively restricting the rolling movement of the rollers 45. Specifically, the rollers 45 may only be locked and unlocked by an operator at the terminal to allow the motorized vehicle to enter and leave the carriage 400.

Figure 30:
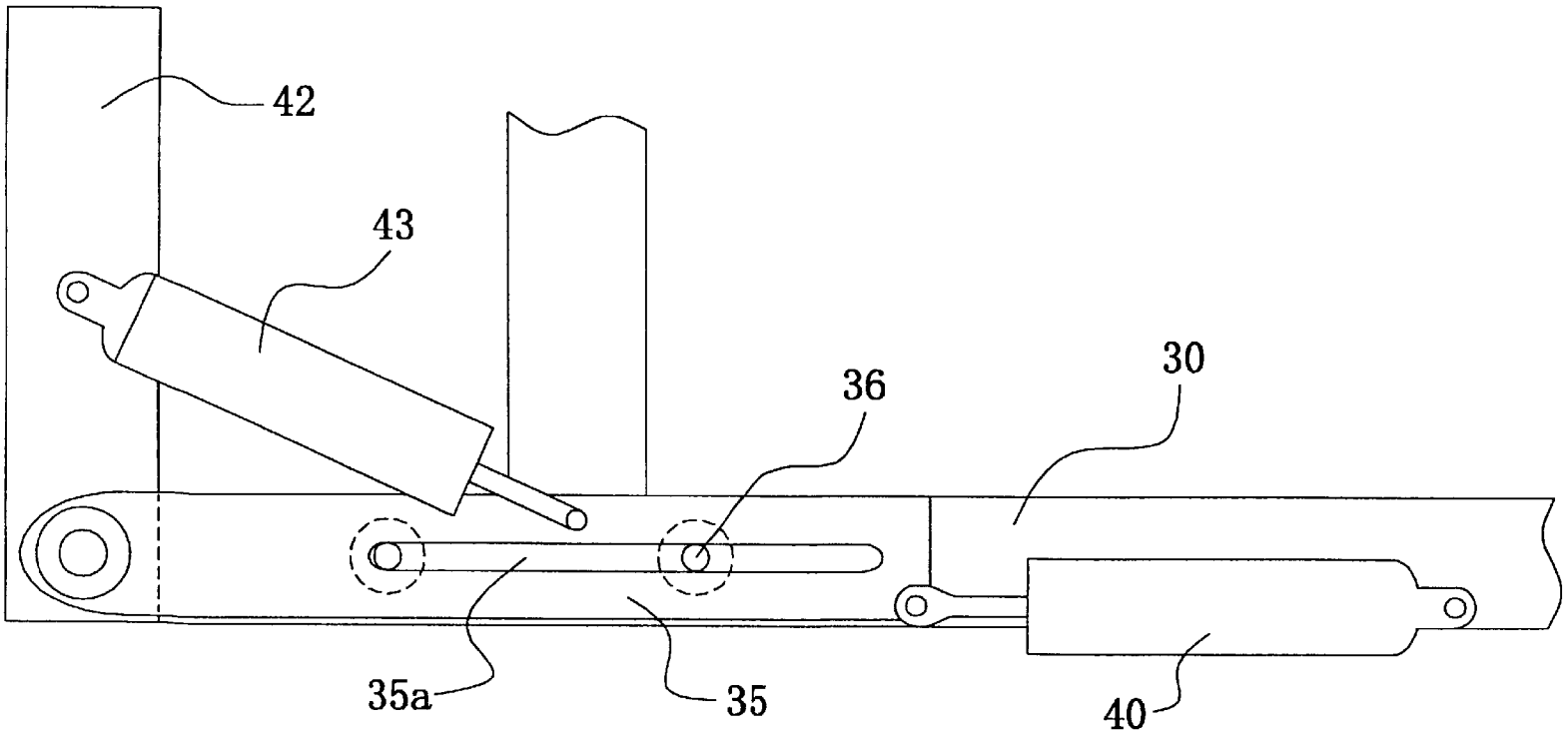
FIG. 30 is a fragmentary side view of a portion of the carriage depicted in FIG. 29.

The carriage depicted in FIGS. 29 and 30 operates as follows. When a car is to be loaded on the carriage 400, the rear gate 32 is lowered and the bar 35 is moved to a forward most position by an operator at the terminal, The brake mechanism (not shown) is engaged such that the rollers 45 may not rotate within the platform 30. A motorized passenger vehicle is then driven onto the carriage 400 and the rollers 45. Once the motorized passenger vehicle is in position, the rear gate 32 is raised and the front gate 42 is moved toward the front of the motorized passenger vehicle by an operator who uses air pressure from an air hose (not shown) to position the sliding bar 35 and front gate 42. It should be noted that the front and rear gates 42 and 32 are lined with a soft material such as foam in order -to protect the motorized passenger vehicle from damage in the event of contact therebetween.

Next, the brake mechanism (not shown) is disengaged such that the rollers 45 may rotate freely within the platform 30. In this situation, the motorized passenger vehicle is secured within the car support mechanism 25 but may not move due to the front and rear gates 42 and 32. Further, in the event that the motor of the motorized passenger vehicle is running and the driver accidently presses on the accelerator, there is no risk of damage to the motorized passenger vehicle since the rollers 45 may rotate freely. Since the tires of the motorized passenger vehicle are engaged with the rollers 45, there is no danger of the motorized passenger vehicle leaving the platform 400.

The cable driven ride described above is ideal for areas that have difficult terrain to drive over or that are protected against development. For instance, the cable driven ride may be used in mountainous areas or wilderness areas where roads are either intrusive or difficult and costly to build. Since the cable driven ride may pass above such areas, there is little if any intrusion by the motorized passenger vehicle on the environment because the motorized passenger vehicles do not need a road and do not necessarily have their motors running while on the cable driven ride.

The cable driven ride may alternatively be what is often referred to as a cable car ride where there are only two carriages employed. The carriages are fixed to the cable such that when the first carriage is in a first terminal, the second carriage is located in the second terminal. The two carriages move toward one another as the cable rotates between the terminals. The two carriages pass one another and continue moving toward the opposite terminal. In such a configuration, the ramp 375 and tracks 360 and 361 would not be necessary since the cable must stop moving as the cars approach the terminals. The carriages are unloaded simultaneously. In other words, when the first carriage moves toward the second carriage, the second carriage moves in the opposite direction towards the first carriage. The two carriages trade places going back and forth between the two terminal. The present invention is intended to apply to such a cable car ride.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A cable-driven ride for conveying park-goers along a course in the park-goers' own motorized passenger vehicles, the ride comprising:

at least one support tower having rollers for supporting an endless cable;

at least one terminal spaced apart form said support tower and including a pulley engaging the endless cable and a motor for driving the pulley, wherein the endless cable extends between said tower and said terminal and is continuously movable between said tower and said terminal;

at least one motor vehicle support carriage configured to releasbly receive and secure a passenger vehicle in safety, said motor vehicle support carriage including a platform and front and rear gates supported on said platform, said front and rear gates being configured to secure the motor vehicle to said platform to prevent movement of the motor vehicle with respect to the carriage, and said platform being further provided with a plurality of rollers selectively brakable against rolling movement, said passenger vehicle support carriage being engagable with the endless cable, wherein said passenger vehicle support carriage is moveable with the cable between said tower and said terminal.

2. A cable-driven ride for conveying park-goers along a course in the park-goers' own motorized passenger vehicles, the ride comprising:

at least one support tower having rollers for supporting an endless cable;

at least one terminal spaced apart from said support tower and including a pulley engaging the endless cable and a motor for driving the pulley, wherein the endless cable extends between said tower and said terminal and is continuously moveable between said tower and said terminal;

at least one motor vehicle support carriage comprising a generally flat platform upon which an automobile is positionable;

at least two generally upright sides extending from said platform; and at least one inflatable bag being fixed to at least one of said upright sides, said inflatable bag being configured for upon inflation abutting against and securing the motor vehicle on said platform, said passenger vehicle support carriage being engagable with the endless cable, wherein said passenger vehicle support carriage is moveable with the cable between said tower and said terminal.

3. The cable-driven ride as set forth in claim 2, said carriage further comprising a gate mounted to said platform, said gate including a second inflatable bag, said second inflatable bag being configured for upon inflation abutting against and securing the motor vehicle on said platform.

4. A ride for conveying park-goers along a course in the park-goers' own motor vehicles, the ride comprising:

at least one zone for loading and unloading motor vehicles into and out of the ride course;

at least one motor-vehicle support means for releasably receiving a motor vehicle and for securing the motor vehicle in safety throughout the ride course according to its dynamics; and means for conveying said motor-vehicle support mechanism along the ride course from and to said zone.

* * * * *